US009386896B2

(12) United States Patent
Smith

(10) Patent No.: US 9,386,896 B2
(45) Date of Patent: Jul. 12, 2016

(54) SURFACE TREATING MACHINE AND DETACHABLE HEADS

(71) Applicant: Yale Smith, Sausalito, CA (US)

(72) Inventor: Yale Smith, Sausalito, CA (US)

( * ) Notice: Subject to any disclaimer, the term of this patent is extended or adjusted under 35 U.S.C. 154(b) by 0 days.

(21) Appl. No.: 14/022,229

(22) Filed: Sep. 10, 2013

(65) Prior Publication Data

US 2015/0173579 A1 Jun. 25, 2015

Related U.S. Application Data

(63) Continuation-in-part of application No. 13/852,514, filed on Mar. 28, 2013.

(51) Int. Cl.

| | |
|---|---|
| ***A47L 11/12*** | (2006.01) |
| ***A47L 11/284*** | (2006.01) |
| ***A47L 11/40*** | (2006.01) |
| ***A47L 11/28*** | (2006.01) |

(52) U.S. Cl.

CPC ..... *A47L 11/12* (2013.01); *A47L 11/28* (2013.01); *A47L 11/4036* (2013.01); *A47L 11/4069* (2013.01); *A47L 11/284* (2013.01)

(58) Field of Classification Search

USPC ..... 15/49.1, 50.1, 50.2, 52.2, 98

See application file for complete search history.

(56) References Cited

U.S. PATENT DOCUMENTS

| | | | | | |
|---|---|---|---|---|---|
| 1,224,292 | A | * | 5/1917 | Fisker | 15/52.2 |
| 1,417,673 | A | * | 5/1922 | Lipscomb | 15/49.1 |
| 2,023,588 | A | * | 12/1935 | Heckroth | 15/49.1 |
| 2,247,993 | A | * | 7/1941 | Fisker | 15/49.1 |
| 3,445,877 | A | * | 5/1969 | Stout | 15/98 |
| 3,795,932 | A | * | 3/1974 | Young | 15/98 |
| 4,321,095 | A | * | 3/1982 | Argo et al. | 134/6 |
| 4,907,313 | A | * | 3/1990 | Roeker et al. | 15/98 |
| 5,249,325 | A | * | 10/1993 | Wilen | 15/4 |
| 5,381,578 | A | * | 1/1995 | Armbruster | 15/98 |
| 7,140,060 | B1 | * | 11/2006 | Walker | 15/98 |
| 8,122,555 | B2 | * | 2/2012 | Kim | 15/98 |
| 8,555,450 | B1 | * | 10/2013 | Sabol et al. | 15/98 |
| 2003/0172480 | A1 | * | 9/2003 | Ueda et al. | 15/98 |
| 2004/0034954 | A1 | * | 2/2004 | Morita et al. | 15/98 |
| 2004/0040579 | A1 | * | 3/2004 | Smith | 134/6 |
| 2004/0103490 | A1 | * | 6/2004 | Long et al. | 15/22.1 |
| 2006/0059640 | A1 | * | 3/2006 | Hornsby et al. | 15/98 |
| 2010/0071143 | A1 | * | 3/2010 | Walker et al. | 15/98 |

FOREIGN PATENT DOCUMENTS

| | | | |
|---|---|---|---|
| JP | 7-39506 | * | 2/1995 |
| JP | 2002-224007 | * | 8/2002 |
| JP | 2004-73566 | * | 3/2004 |

* cited by examiner

*Primary Examiner* — Mark Spisich
(74) *Attorney, Agent, or Firm* — David E. Lovejoy

(57) ABSTRACT

A machine for treating a surface lying in an XY-plane comprising a body, a body plate attached to the body, a drive assembly attached to the body and a cleaning plate assembly. The drive assembly includes a motor having a motor and a transmission driven by the motor. The cleaning plate assembly includes a cleaning plate connected to the transmission to be driven in an oscillating pattern parallel to the XY-plane and relative to the body plate. The cleaning plate assembly includes a cleaning head detachably fastened to the cleaning plate. The cleaning head includes one of a hook or loop surface and the cleaning plate includes the other one of a hook or loop surface whereby the cleaning head is detachably fastened to the cleaning plate by loop and hook fastening.

19 Claims, 14 Drawing Sheets

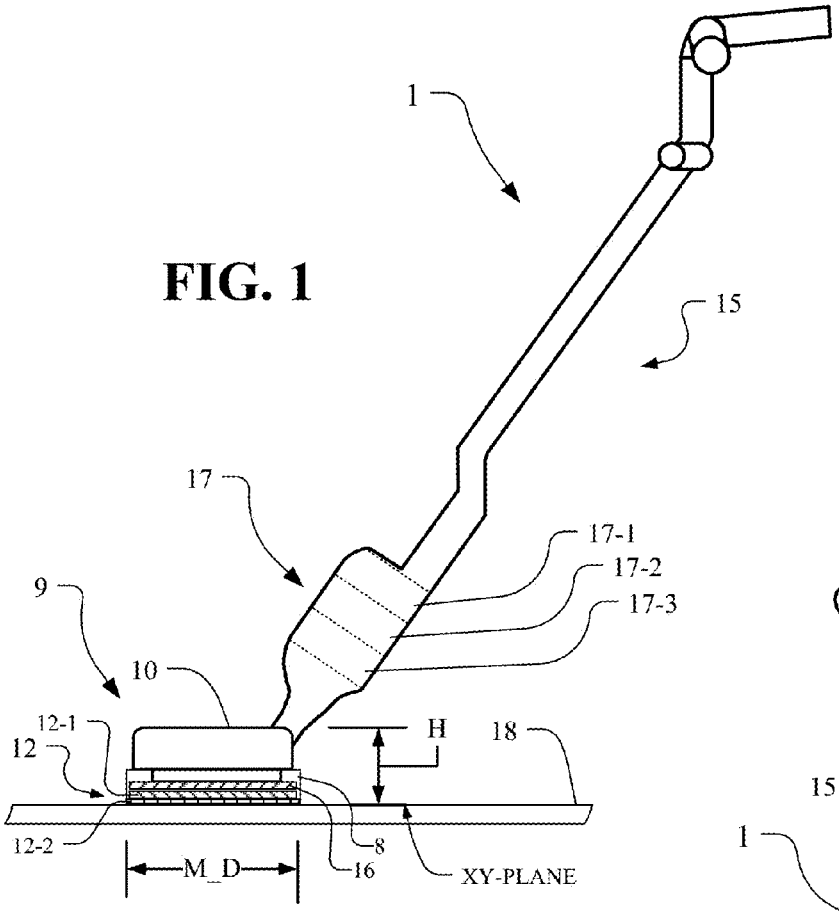
FIG. 1
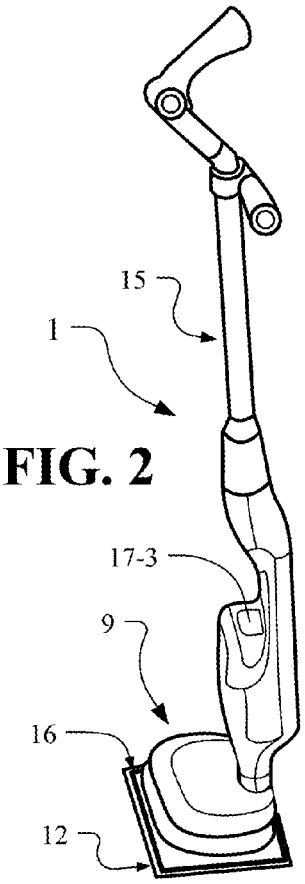
FIG. 2
FIG. 3
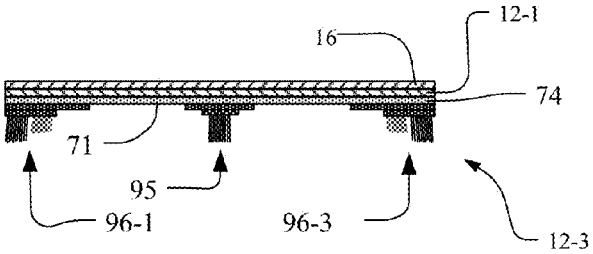

SURFACE TREATING MACHINE AND DETACHABLE HEADS

BACKGROUND OF THE INVENTION

This invention relates to a machine for treating work surfaces such as floors formed of carpet, tile, wood and other materials. The most efficient and effective surface treatments employ a vibration, "scrubbing", motion to loosen materials on the work surface. On floors and other work surfaces, a machine typically uses cleaning heads such as towels, pads, mop heads and brush heads in combination with a solvent, including water or steam, and/or a cleaning agent. When the cleaning towel scrubs the floor and becomes dirty, the towel is replaced with a clean one.

In US Patent publication 20070107150 A1 having inventor Yale Smith and published May 17, 2007, a Carpet Cleaning Apparatus And Method With Vibration, Heat, And Cleaning Agent is described. In that patent publication, a combination of vibratory motion, controllable heat, and cleaning agents are used. The apparatus includes a base cleaning plate, heating elements with electrical connections, and means for moving the cleaning plate to produce a scrubbing motion.

In PCT application entitled SURFACE TREATING MACHINE filed Dec. 8, 2010 and having Ser. No. PCT/US2010/059347 and invented by Yale Smith; in U.S. application entitled IMPROVED SURFACE TREATING MACHINE filed Dec. 15, 2012 and having Ser. No. 61/737,740 and invented by Yale Smith; and in U.S. application entitled IMPROVED SURFACE TREATING MACHINE filed Mar. 28, 2013 and having Ser. No. 13/852,514 and invented by Yale Smith various improvements in surface treating machines are described. These applications describe surface treating machines which have counter rotating drives which help provide forward motion drive without a tendency to veer left or right of the forward direction of travel.

Important attributes of surface treating machines are cleaning effectiveness, ease of use, convenience, stability, light weight, low machine wear, long life and ease of maintenance. These attributes are important for machines used by professionals in heavy duty environments and are important for machines used by others in home or other light duty environments.

Cleaning effectiveness requires that machines include a small oscillation that creates a local vibration in a cleaning plate to impart a "scrubbing" movement to the surface being treated. For cleaning floors, the local vibration is preferably in a range that includes several millimeters. Cleaning effectiveness and convenience requires that the shape of the cleaning plate be rectangular so as to be readily used along straight edges and easily moved into rectangular corners. In order to satisfy these attributes, machines with round bottom plates are undesirable.

Ease of use and convenience require stability, appropriate size and weight and ease of operator control. Designs that position the motor and drive assembly high above the cleaning plate are undesirable since such configurations tend to accentuate vertical instability. Vertical instability results in unwanted oscillation of the cleaning plate up and down in a mode that is in and out of the plane of the work surface. The plane of the work surface is referred to as the floor surface plane or the XY-plane. Vertical instability is distinguished from horizontal oscillations providing local vibration to impart a "scrubbing" movement to the cleaning plate. The horizontal oscillations are parallel to the plane of the work surface, that is, parallel to the XY-plane. Vertical instability is additionally undesirable because it uses excessive amounts of energy, reduces the energy efficiency of the machine and causes increased wear on the motor, the dive shafts, the drivers and the drive bushings. The increased wear increases maintenance and decreases the life of the machine. Also, user fatigue is dramatic when unwanted vertical oscillations occur.

High energy efficiency is an important attribute. For machines powered by an AC electrical service through an AC-to-DC converter or powered by a battery, the size and cost of the motor is a function of the energy requirements needed to drive the transmission and the cleaning plate. For DC motors, the energy requirements are important for the motor and for the AC-to DC converter used to convert the AC electrical service to DC. The more energy efficient the machines, the smaller and less expensive are the AC-to-DC converters, batteries and motors required to power the machines.

Another factor in cleaning effectiveness is determined by the material of the machine in contact with the floor material. Brushes are not absorbent and therefore are inefficient in removing solid and liquid matter from a floor. For existing machines that use a towel, the towels are typically synthetic and do not absorb and hold solid and liquid matter from a floor. For towels that are primarily cotton, they have the disadvantage of not scrubbing well and also have high friction with the floor surface resulting in low energy efficiency.

Cleaning effectiveness for tile floors having grout between tiles is often unsatisfactory since dirt and grime is often pushed into the grout region. This problem is often worse in corners that are difficult for machines to penetrate.

In light of the above background, it is desirable to have improved surface treatment machines for treating carpets, tiles, wood and other surface materials.

SUMMARY

The present invention is a machine for treating a surface lying in an XY-plane comprising a body, a body plate attached to the body, a drive assembly attached to the body and a cleaning plate assembly. The drive assembly includes a motor having a motor and a transmission driven by the motor. The cleaning plate assembly includes a cleaning plate connected to the transmission to be driven in an oscillating pattern parallel to the XY-plane and relative to the body plate. The cleaning plate assembly includes a cleaning head detachably fastened to the cleaning plate. The cleaning head includes one of a hook or loop surface and the cleaning plate includes the other one of a hook or loop surface whereby the cleaning head is detachably fastened to the cleaning plate by loop and hook fastening.

In one embodiment, the cleaning head includes a mop head including a cleaning fiber attached to a hook or loop layer. Typically, the cleaning fiber is a polypropylene microfiber formed of cylinders with approximately 12 cylinders per square inch where each cylinder has a diameter of approximately 0.25 inch and a height of approximately 0.6 inch.

In one embodiment, the cleaning head includes a brush head attached to a hook or loop layer. Typically, the brush head includes a loop and hook assembly having a loop layer on one side and a hook layer on the other side for attachment to the cleaning plate and the brush head includes one or more brush heads fastened to the loop and hook assembly.

In one embodiment, two or more of the brush heads are spaced apart by a dimension that matches the grout spacing of a tile floor to be cleaned.

The foregoing and other objects, features and advantages of the invention will be apparent from the following detailed description in conjunction with the drawings.

BRIEF DESCRIPTION OF THE DRAWINGS

FIG. 1 depicts a side view of one embodiment of a surface treating machine on a surface to be treated.

FIG. 2 depicts an isometric view of another surface treating machine of the FIG. 1 type.

FIG. 3 depicts an embodiment of a cleaning plate assembly of the surface treating machine of FIG. 1 and FIG. 2 having brushes.

DETAILED DESCRIPTION

Figure 4:
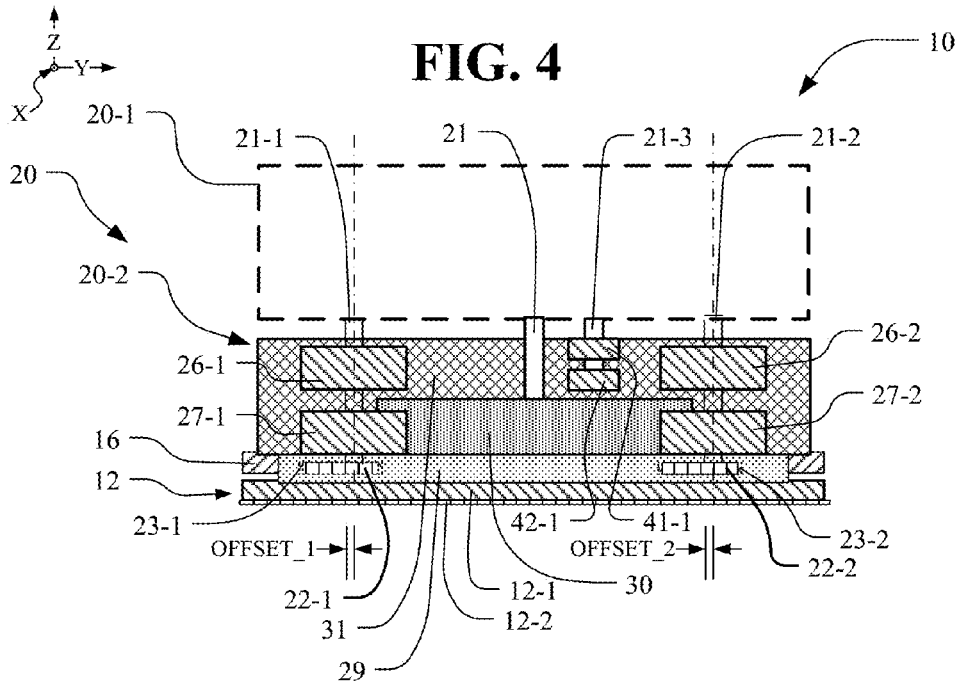
FIG. 4 depicts a front view with further details of one embodiment of the drivers and the cleaning plate assembly of the machine of FIG. 1.

In FIG. 1, a surface treating machine 1 includes a body 9 including a drive assembly 10 and a cleaning plate assembly 12. A body plate 16 is rigidly attached as part of the body 9. The cleaning plate assembly 12 is driven by the drive assembly 10 for cleaning or polishing the floor surface lying in a floor plane denominated as the XY-plane. The cleaning plate assembly 12 includes a cleaning plate 12-1 and a cleaning pad (mop head) 12-2. In some embodiments, the machine 1 includes a skirt 8 attached as part of the body 9 and superimposed over the edges of cleaning plate assembly 12.

In FIG. 1, the machine 1 includes a handle assembly 15 affixed to the body 9 for enabling a user to guide machine 1 over a floor surface 18 lying in the XY-plane. The handle assembly 15 has a length extending from the body 9 at a variable angle with the XY-plane. One or more compartments 17 are attached to or are in the handle assembly 15. The compartments include, for example, one or more fluid compartments 17-1 for storing water, cleaners or other solutions and one or more electrical compartments for housing an AC-to-DC converter 17-2 or a battery 17-3. The handle assembly may include items not explicitly shown such as an AC power cord, a power plug for operation with an AC-to-DC converter, an electrical control line and an ON/OFF switch. The handle assembly 15 is rotationally attached to body 9 and adjusts to acute angles with the cleaning surface when in use for cleaning The handle assembly 15 includes a latch for latching the handle assembly 15 in the vertical position for transport and storage of the machine 1 when not in operation.

The drive assembly 10 has a drive assembly height dimension, H, measured from the XY-plane. The cleaning plate assembly 12 typically has a length and a width lying in the XY-plane of the floor surface. The smaller one of the length and the width dimensions, or the only dimension if the length and width are equal, of the cleaning plate assembly 12 is the minimum treatment dimension, M_D. In order to provide stability for the machine 1, the height dimension, H, typically is less than one half of the minimum treatment dimension, M_D. A low drive assembly height dimension is important in minimizing or preventing unwanted vertical instability. Vertical instability results in unwanted oscillation of the cleaning plate up and down in a mode that is in and out of the XY-plane of the work surface. Such unwanted oscillations are a complex function of the floor surface material and movements of the machine during operation as well as the design of the machine. For normal and intended operation, the machine is operating with oscillations in the XY-plane of the floor surface. When the machine is moved from location to location on a floor by a machine operator, some forces out of the XY-plane inherently result. If the drive assembly 10 height dimension, H, is too high, these forces out of the XY-plane tend to accumulate in intensity reaching a resonant vibration frequency identified as vertical instability. Such vertical instability can be difficult to control by an operator and is wasteful of energy. In some embodiments, the vertical instability is minimized or eliminated by having the drive assembly height dimension, H, less than one half of the minimum treatment dimension, M_D.

In FIG. 2, an isometric view of the surface treating machine 1 of FIG. 1 is shown. The surface treating machine 1 includes a body 9 with a handle assembly 15. The handle assembly 15 is shown latched in the upright position. The cleaning plate assembly 12 is driven by the body 9 in an oscillating pattern. The surface treating machine 1 of FIG. 2 includes only a single compartment 17-3 for a battery.

In FIG. 3, an embodiment of a cleaning plate assembly 12 of the surface treating machine 1 of FIG. 1 and FIG. 2 is shown having a brush head 12-3. The brush head 12-3 replaces the mop head 12-2 in FIG. 1. The brush head 12-3 includes a loop and hook assembly 74 having brush head 96-1, brush head 95 and brush head 96-3 fastened to the hook layer 71 of the loop and hook assembly 74. The brush head 96-1, brush head 95 and brush head 96-3 are each removable fastened to the loop and hook assembly 74 and hence any one or more of the brush heads maybe employed and the spacing between brush heads can be readily adjusted. Such adjustment is useful for alignment with grout lines in a tile floor.

In FIG. 4, a front view with further details of one embodiment of the drive assembly 10, the body plate 16 and the cleaning plate assembly 12 of FIG. 1 is shown. The drive assembly 10 includes a motor 30 and a transmission 20. The transmission 20 includes a first transmission assembly part 20-1 and a second transmission assembly part 20-2. The first transmission assembly part 20-1 connects to the second transmission assembly part 20-2 through a motor drive shaft 21, a first drive shaft 21-1, and a second drive shaft 21-2 and a third drive shaft 21-3. In the second transmission assembly part 20-2, a base 31 supports the motor 30 and the first drive shaft 21-1, the second drive shaft 21-2 and the third drive shaft 21-3.

The first drive shaft 21-1 is supported by first bearings 26-1 and 27-1 in the base 31 which connects to a first offset driver 22-1. A first bushing 23-1 engages the first offset driver 22-1. The second drive shaft 21-2 is supported by second bearings 26-2 and 27-2 in the base 31 which connects to a second offset driver 22-2. A second bushing 23-2 engages the second offset driver 22-2. The first bushing 23-1 and the second bushing 23-2 are mounted in the eccentric drive member 29. The first offset driver 22-1 and the second offset driver 22-2 rotate in first bushing 23-1 and the second bushing 23-2, respectively. Because the first offset driver 22-1 and the second offset driver 22-2 have offsets from the center lines of drive shafts 21-1 and 21-2, the eccentric drive member 29 oscillates within an opening in the body plate 16. In some embodiments, a drive shaft 21-3 is supported by bearings 41-1 and 42-1 in the base 31.

The transmission first assembly part 20-1 operates to transfer the rotational motion of the drive shaft 21 to the drive shafts 21-1 and 21-2 and thereby to the offset drivers 22-1 and 22-2. The offset drivers 22-1 and 22-2 drive the cleaning plate assembly 12 in a vibrating motion in the XY-plane by a ±OFFSET_D. The offset driver 22-1 has an OFFSET_1 offset from the center axis of the drive shaft 21-1 by the offset OFFSET_1 that is equal to OFFSET_D. The offset driver 22-2 has an OFFSET_2 offset from the center axis of the drive shaft 21-2 by the offset OFFSET_2 that is equal to OFFSET_D. The offset drivers 22-1 and 22-2 each have a driver offset, equal to OFFSET_D, measured from a center axis of the respective offset driver drive shaft whereby the cleaning plate assembly 12 is constrained to move in a treatment region bounded by approximately+/−the driver offset.

In FIG. 4, the motor drive shaft 21 and portions of the transmission 20 are located with the motor drive shaft 21 extending in the +Z-axis direction, a direction away from and normal to the XY-plane. The transmission 20 connects from the motor drive shaft 21 around the motor 30 to the bushings 23-1 and 23-2 in the eccentric drive member 29. The positioning of portions of the transmission 20 above the motor 30 and away from the XY-plane of the floor surface is desirable in that it enables ready and easy access for repair or other servicing and keeps those portions of the transmission 20 away from the potentially wet or dirty cleaning environment of the floor surface at the XY-plane.

In FIG. 4, the motor 30 in one embodiment is a pancake shaped printed motor that is compact in size, high in output torque, high in energy efficiency, 75%-85%, high in reliability and low in noise using rare earth magnets and operable in voltages from 12 volts to 48 volts. Such motors are sold, for example, by Golden Motors of Shanghai, China. The DC motors have a higher starting torque than AC motors. The low DC voltages provide good user safety and are battery capable. In one embodiment described, the motor 30 has a no-load operation at 3600 RPM which is reduced by the transmission to 2500 RPM. In another embodiment, the motor 30 has a no-load operation at 2880 RPM which is reduced by the transmission to 1800 RPM.

Figure 5:
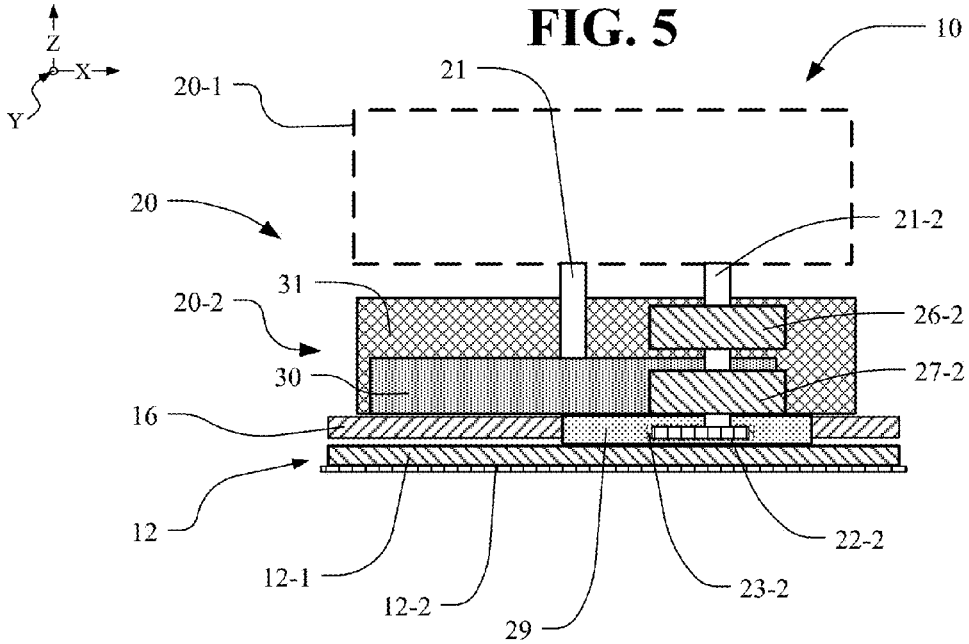
FIG. 5 depicts a side view of the drivers and the cleaning plate assembly of FIG. 4.

In FIG. 5, a side view of the drive assembly 10, the body plate 16 and the cleaning plate assembly 12 of FIG. 4 are shown. The drive assembly 10 includes a motor 30 and a transmission 20. The base 31 supports the motor 30 and the transmission 20. The transmission 20 includes a first transmission assembly part 20-1 and a second transmission assembly part 20-2. In FIG. 5, the first transmission assembly part 20-1 connects to the second transmission assembly part 20-2 through a motor drive shaft 21 and a second drive shaft 21-2. In the second transmission assembly part 20-2, a base 31 supports the motor 30 and the second drive shaft 21-2. The second drive shaft 21-2 is supported by second bearings 26-2 and 27-2 and connects to the second offset driver 22-2. A second bushing 23-2 in the eccentric drive member 29 engages the second offset driver 22-2. The transmission 20 operates to transfer the rotational motion of the drive shaft 21 to the drive shaft 21-2 and thereby to the offset driver 22-2. The offset driver 22-2 drives the cleaning plate assembly 12 with a vibrating motion.

Figure 6:
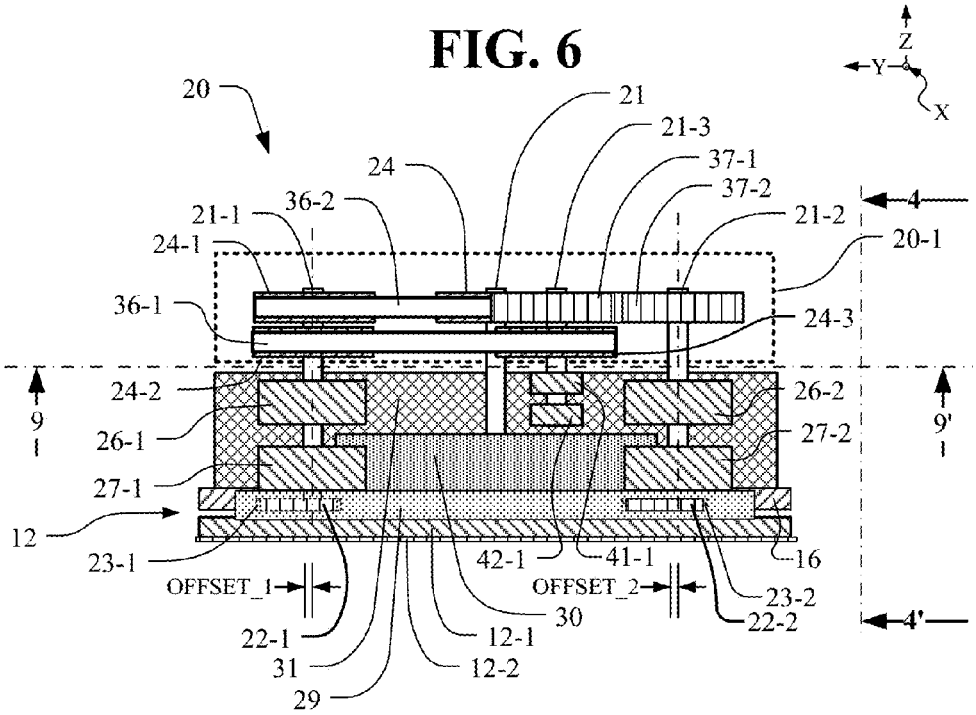
FIG. 6 depicts a front view of the gears, pulleys and belts that form a part of one embodiment of the transmission for the surface treating machine of FIG. 1 and FIG. 2.

In FIG. 6, a front view with further details of one embodiment of the drive assembly 10, the body plate 16 and the cleaning plate assembly 12 of FIG. 1 is shown. The drive assembly 10 includes a motor 30 and a transmission 20. The transmission 20 includes a first transmission assembly part 20-1 and a second transmission assembly part 20-2. The first transmission assembly part 20-1 connects to the second transmission assembly part 20-2 through a motor drive shaft 21, a first drive shaft 21-1, and a second drive shaft 21-2 and a third drive shaft 21-3. In the second transmission assembly part 20-2, a base 31 supports the motor 30 and the first drive shaft 21-1, the second drive shaft 21-2 and the third drive shaft 21-3.

The first drive shaft 21-1 is supported by first bearings 26-1 and 27-1 in the base 31 which connects to a first offset driver 22-1. A first bushing 23-1 in the eccentric drive member 29 engages the first offset driver 22-1. The second drive shaft 21-2 is supported by second bearings 26-2 and 27-2 in the base 31 which connects to a second offset driver 22-2. A second bushing 23-2 in eccentric driver 29 engages the second offset driver 22-2. The third drive shaft 21-3 is supported by third bearings 41-1 and 42-1 in the base 31.

The transmission first assembly 20-1 operates to transfer the rotational motion of the drive shaft 21 to the drive shafts 21-1 and 21-2 and thereby to the offset drivers 22-1 and 22-2. The transmission assembly 20-1 in one embodiment includes motor pulley 24 connected to the motor drive shaft 21, a first pulley 24-1 connected to a first drive shaft 21-1 and a second pulley 24-2 connected to the second drive shaft 21-2. A third pulley 24-3 is connected to the drive shaft 21-3. A gear 37-1 connects to the drive shaft 21-3. A gear 37-2 connects to the drive shaft 21-3. The gear 37-1 engages and in operation rotates the gear 37-2.

The pulleys 24, 24-1, 24-2 and 24-3 together with the gears 37-1 and 37-2, as part of the transmission 20, operate to transfer the rotational motion of the drive shaft 21 from motor 30 to the drive shafts 21-1 and 21-2. The motor pulley 24 is driven in the clockwise direction and drives pulley 24-1 and drive shaft 21-1 in the clockwise direction through belt 36-2. The pulley 24-2, attached to drive shaft 21-1, is driven in the clockwise direction and drives pulley 24-3 and gear 37-1 attached to drive shaft 21-3 in the clockwise direction through belt 36-1. The gear 37-1 attached to drive shaft 21-3 and driven in the clockwise direction engages gear 37-2 and turns gear 37-2 and drive shaft 21-2 in the counterclockwise direction. The pulleys 24-2 and 24-3 are of the same diameter and design so that the drive shafts 21-1 and 21-3 turn in the same direction and at the same speed. The gear 37-1 and the gear 37-2 are of the same diameter and design so that the drive shafts 21-3 and 21-2 turn at the same speed but rotate in opposite directions. Because the first offset driver 22-1 and the second offset driver 22-2 have offsets from the center lines of drive shafts 21-1 and 21-2, the eccentric drive member 29 oscillates within an opening in the body plate 16.

Figure 7:
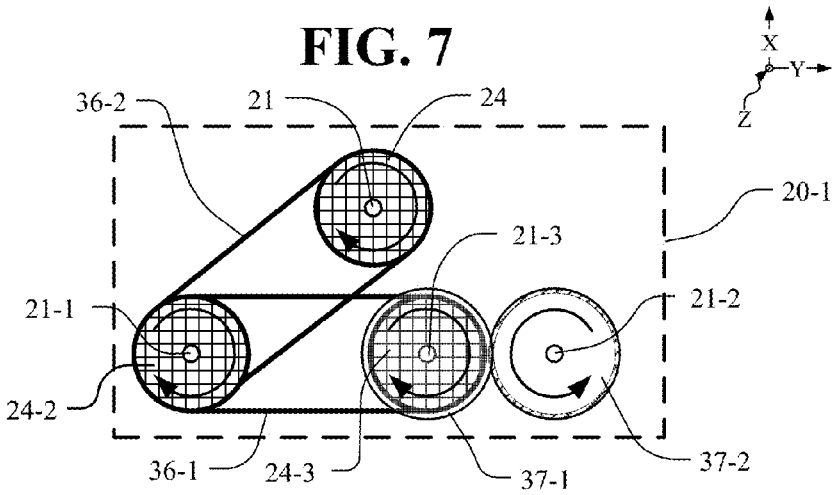
FIG. 7 depicts a top view of the gears, pulleys and belts of FIG. 6.

In FIG. 7, a bottom view is shown of the transmission first assembly 20-1 of FIG. 6 taken along the section line 6-6' in FIG. 6. The transmission first assembly 20-1 operates to transfer the rotational motion of the drive shaft 21 to the drive shafts 21-1 and 21-2. The transmission assembly 20-1 includes motor pulley 24 connected to the motor drive shaft 21, a first pulley 24-1, not shown in FIG. 7, see FIG. 6, connected to a first drive shaft 21-1 and a second pulley 24-2 connected to the first drive shaft 21-1. A third pulley 24-3 is connected to the drive shaft 21-3. A gear 37-1 also connects to the drive shaft 21-3. A gear 37-2 connects to the drive shaft 21-3. The gear 37-1 engages the gear 37-2. The pulleys 24-2 and 24-3 are of the same diameter and design so that the drive shafts 21-1 and 21-3 turn in the same direction and at the same speed. The gear 37-1 and the gear 37-2 are of the same diameter and design so that the drive shafts 21-3 and 21-2 turn at the same speeds but in the opposite directions.

Figure 8:
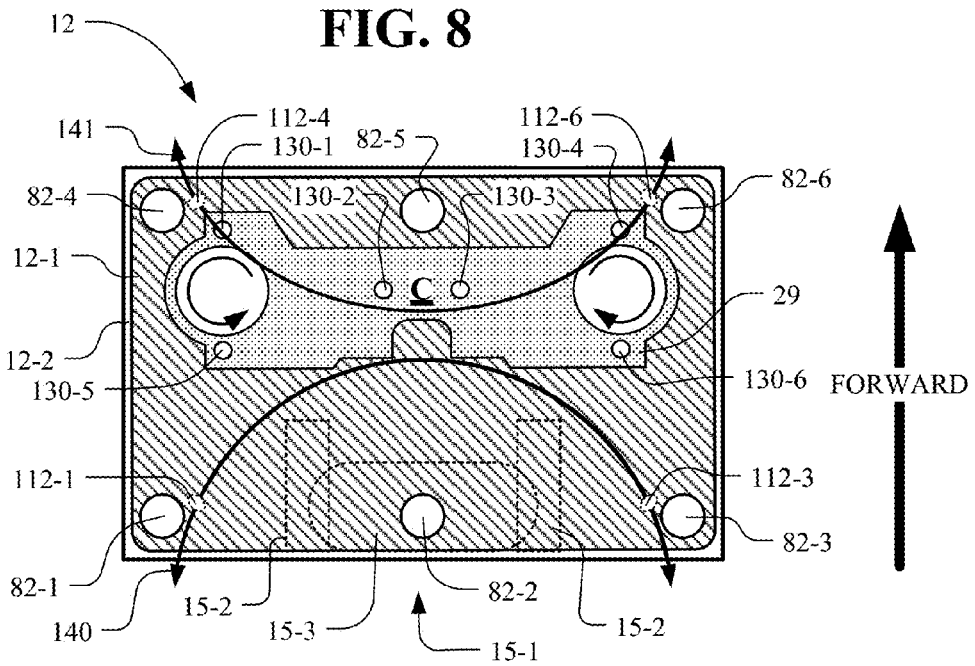
FIG. 8 depicts a top view of an embodiment of the cleaning plate assembly and eccentric drive member of FIG. 9.
Figure 9:
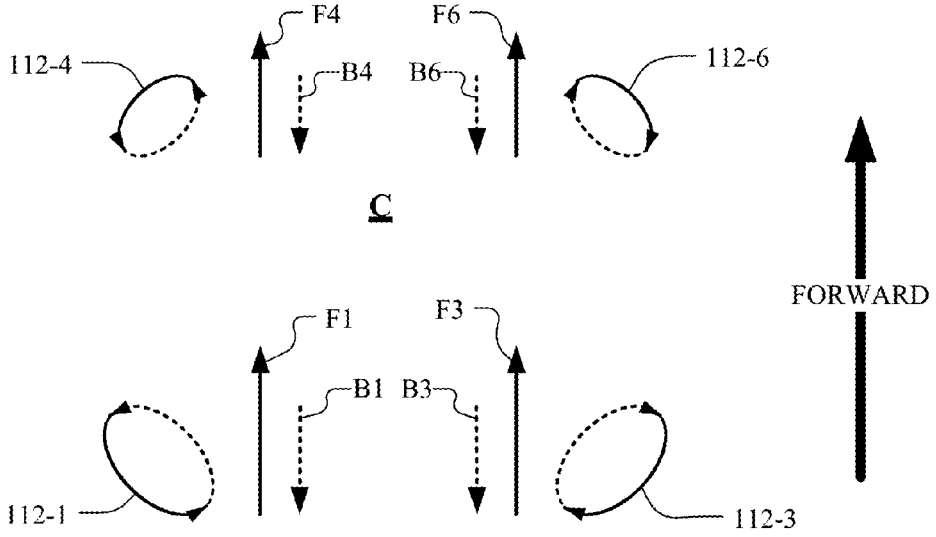
FIG. 9 depicts a diagram representing the forward drive of the geometry of the cleaning plate assembly and eccentric drive member of FIG. 8.

In FIG. 8, a top view is shown of an embodiment of the cleaning plate assembly 12 and eccentric drive member 29. The handle assembly 15-1 is shown with broken lines to show the orientation of the cleaning plate assembly 12. The orientation in the FORWARD direction is indicated by the arrow. The eccentric drive member 29 is rigidly attached to cleaning plate 12-1 by the bolts 130, including bolts 130-1, 130-2, 130-3, 130-4, 130-5 and 130-6. The bolts 130 are fully tightened and the concave arc of the cleaning plate 12-1 and cleaning pad 12-2 as shown in FIG. 9 is shown schematically in FIG. 59 as the arrow 140. The entire cleaning plate assembly 12 has the concave shape as further represented by arrow 141. In operation as described in connection with FIG. 18 and FIG. 19, the entire cleaning plate assembly 12 has an oscillator motion. The vibrating cleaning plate 12-1 includes pockets 82-1, 82-2, . . . , 82-6 for receiving ball bearings which are in the pockets 81-1, 81-2, . . . , 81-6, respectively, of body plate 16, see FIG. 23 and FIG. 25. The ball bearings in the pockets 82-1 and 82-4 have a generally oval-shaped counter-clockwise rotation and the ball bearings in the pockets 82-3 and 82-6 have a generally oval-shaped clockwise rotation. Similarly, areas of the cleaning pads in the vicinity of the pockets 82-1 and 82-4 in the vicinity of the pockets 82-3 and 82-6 have generally the same counter-clockwise and clockwise rotations, respectively. The typical cleaning pad locations 112-1 and 112-4 in the vicinity of the pockets 82-1 and 82-4 have counter-clockwise rotations and the typical cleaning pad locations 112-3 and 112-6 in the vicinity of the pockets 82-3 and 82-6 have clockwise rotations. The cleaning pad locations 112-1 and 112-4 and the cleaning pad locations 112-3 and 112-6 are selected as typical since the entire cleaning pad 12-2 is a continuum of many such small locations.

In FIG. 9, a diagram is shown for explaining the forward drive of the geometry of the cleaning plate assembly 12 and eccentric drive member 29 of FIG. 8. The clockwise rotation of the cleaning pad locations 112-1 and 112-4 is depicted as having two parts, a solid part farthest away from the center of the concave shape and a broken-line part closer to center, C, of the concave shape. Because of the concave shape, the solid part tends to be pushed harder toward the floor or other surface being treated than the broken-line part. Accordingly, the forward force, F1, for the counter-clockwise oscillation 112-1 is greater than backward force, B1. The net force in the forward direction for the oscillation 112-1 is the difference, F1-B1. In a similar manner, the forward force, F4, for the counter-clockwise oscillation 112-4 is greater than backward force, B4. The net force in the forward direction for the counter-clockwise oscillation 112-4 is the difference, F4-B4. In a similar manner, the forward force, F3, for the clockwise oscillation 112-3 is greater than backward force, B3. The net force in the forward direction for the clockwise oscillation 112-3 is the difference, F3-B3. In a similar manner, the forward force, F6, for the clockwise oscillation 112-6 is greater than backward force, B6. The net force in the forward direction for the clockwise oscillation 112-6 is the difference, F6-B6.

When all the net forces as described in connection with FIG. 9 are summed, the result is a positive FORWARD drive force that helps propel the machine 1 of FIG. 1 and FIG. 2 forward rendering the machine easier to use. If the direction of rotation of the motor is reversed, then the driving direction is reversed to backward.

When a user is pushing the machine 1 of FIG. 1 and FIG. 2 in the forward direction, the resulting force on the handle 15, attached as shown in FIG. 8, exerts an increased force at the rear of the cleaning plate 12-1. This increased force tends to increase the forces of the F1 and F3 type and hence increase the FORWARD drive. Similarly, when a user is pulling the machine 1 of FIG. 1 and FIG. 2 in the backward direction, the resulting force on the handle 15, attached as shown in FIG. 8, exerts a decreased force at the rear of the cleaning plate 12-1 thereby reducing the FORWARD drive and making it easier to pull the machine backward.

Figure 10:
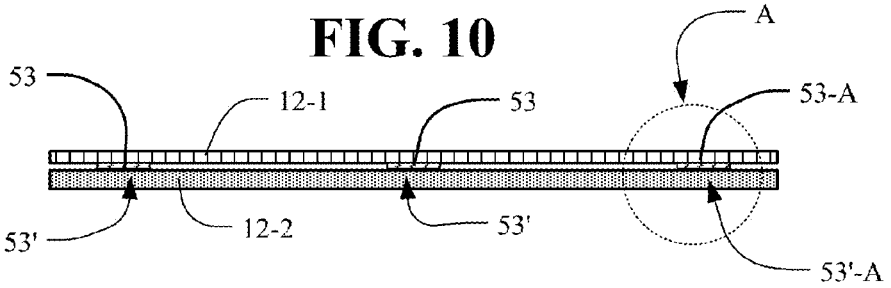
FIG. 10 depicts one embodiment of a cleaning pad affixed to the cleaning plate with fasteners.

In FIG. 10, a front view is shown of the cleaning plate 12-1 and the cleaning pad 12-2. The pad 12-2 is attached to the cleaning plate 12-1 by hook-and-loop fasteners where the hooks 53, including hook 53-A, is attached to the cleaning plate 12-1 and the "loops", including loop 53'-A, are part of the pad 12-2.

Figure 11:
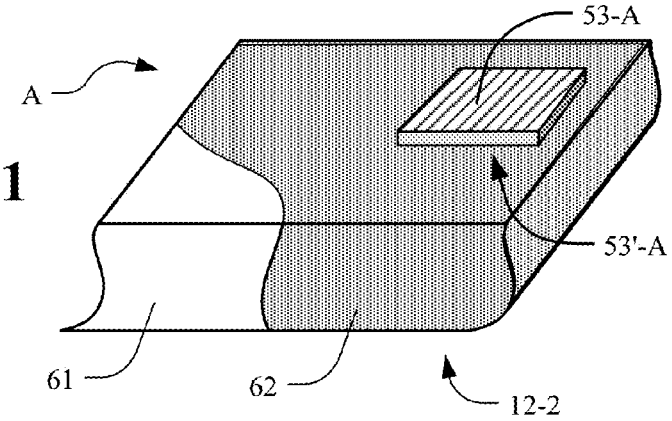
FIG. 11 depicts a perspective view of a portion of the cleaning pad of FIG. 10.

In FIG. 11, a perspective view is shown of a cutaway section A of the cleaning pad (mop head) 12-2 of FIG. 10. The hook-and-loop fastener 53-A and 53'-A are typical of the hook-and-loop fasteners of FIG. 10. The loop portion 53'-A is fulfilled by the cover 62 that surrounds the cotton center 61. In addition to providing the "loop" function of the hook-and-loop fastening, the cover 62 is more abrasive then the cotton core 61. The more abrasive cover 62 functions when cleaning to dislodge more stubborn stains and particles. By way of contrast, the cotton center 61 is more absorbent and tends to absorb stains and particles dislodged by the abrasive cover 62 and by any liquid applied, such as water or cleaning solution.

Figure 12:
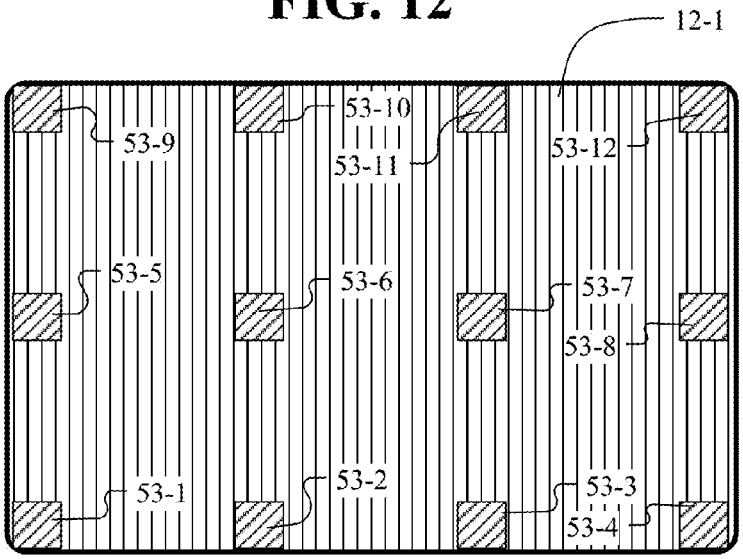
FIG. 12 depicts a bottom view of the cleaning plate having a number of hook attachment pads.

In FIG. 12, a bottom view is shown of the cleaning plate 12-1 and the attachment pads 53. The attachment pads 53-1, 53-2, . . . , 53-12 perform the "hook" function of the hook-and-loop fastening as described in connection with FIG. 11.

The sizes of loops and hooks vary over a large range. In different embodiments, small hook sizes range from 0.02 inch to 0.05 inch and large hook sizes range from 0.08 inch to 0.25 inch. In one example, the hooks 53, such as 53-A, are about 0.04 inch and the loops, such as loop 53'-A, have matching loop sizes to form a good loop and hook fastening.

Figure 13:
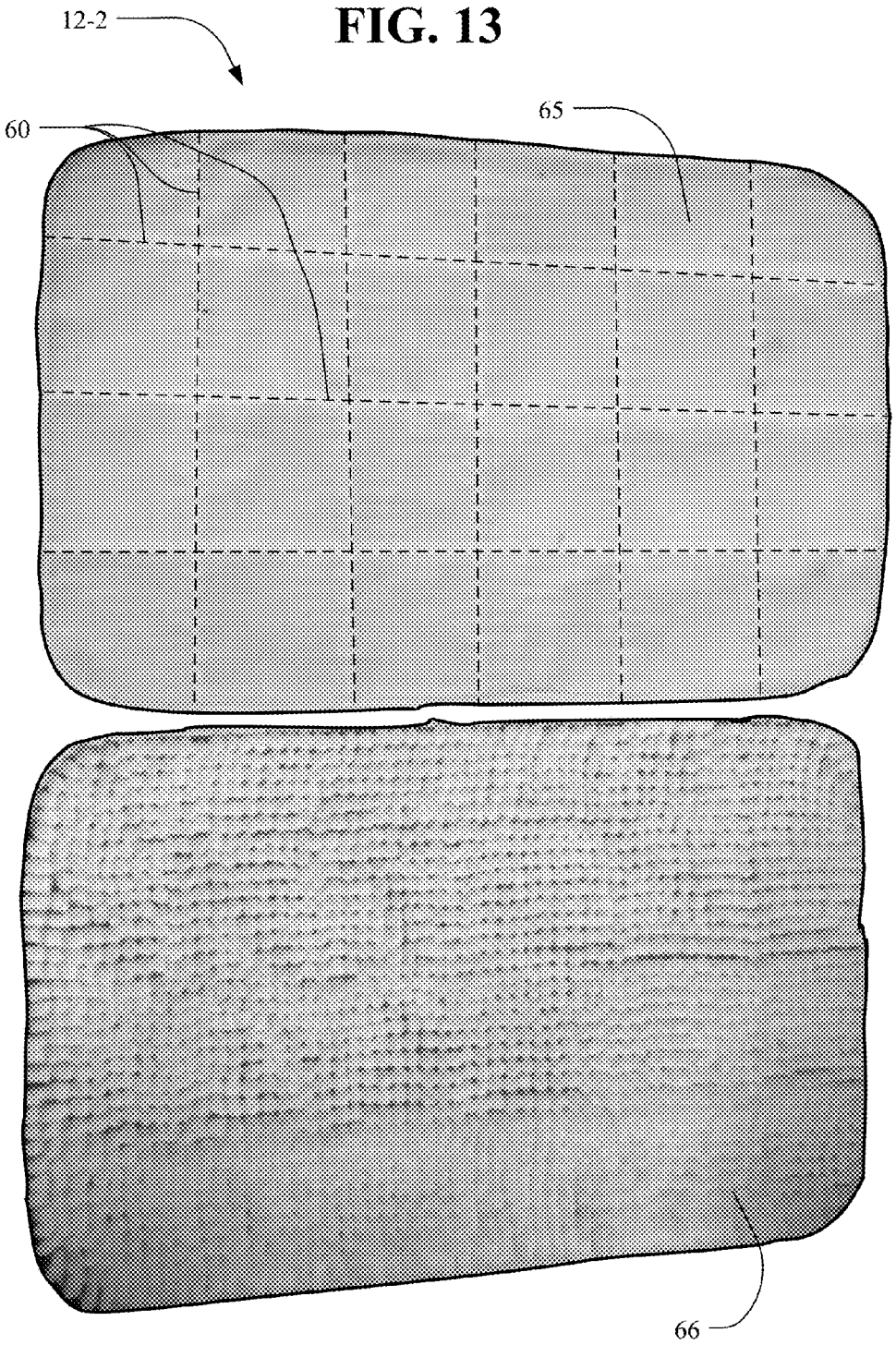
FIG. 13 depicts top and bottom sides of another embodiment a cleaning pad.

In FIG. 13, a loop layer 65 and a fiber layer 66 form top and bottom sides of another embodiment a cleaning pad (mop head) 12-2. In the embodiment of FIG. 13, the loop layer 65 is sewn to the fiber layer 66 along thread lines 60. In one example, the loop layer 65 is selected to fasten to hooks that are about 0.04 inch so as to form a good loop and hook fastening to the hook pads 53 of FIG. 12. The fiber layer 66 is a chenille fiber and more particularly is polypropylene microfiber. The fiber layer 66 has approximately 12 cylinders per square inch where each cylinder has a diameter of approximately 0.25 inch and a height of approximately 0.6 inch.

Figure 14:
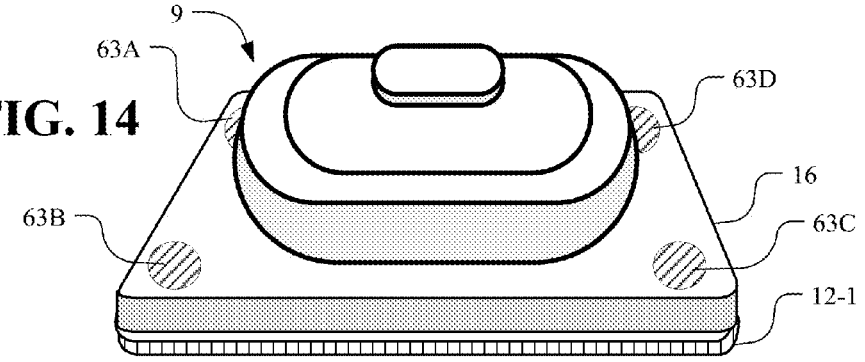
FIG. 14 depicts one embodiment of a body portion of a surface treating machine without a handle.

In FIG. 14, one embodiment of a body 9 of a surface treating machine of the FIG. 1 or FIG. 2 type is shown (with the handle removed). The body 9 includes the body plate 16 which engages and oscillates the cleaning plate 12-1. The cleaning plate 12-1 has "hooks" as described in connection with FIG. 12. The body plate 16 includes hook connectors 63 including hook connectors 63A, 63B, 63C and 63D. The hook connectors 63 are located on the top surface of and generally in the four corners of the body plate 16. The hooks on the hook connectors 63 are about 0.04 inch so as to form a good loop and hook fastening to the loops of the loop layer 65 of FIG. 13. The hook connectors 63 are positioned to engage loop material of a cleaning pad, if desired, as described in connection with FIG. 15 through FIG. 18.

Figure 15:
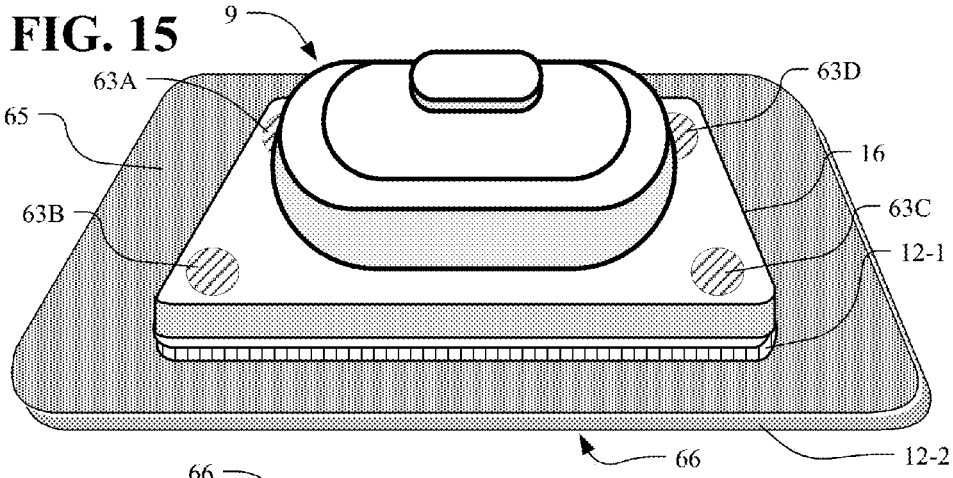
FIG. 15 depicts the body portion of a surface treating machine of FIG. 14 on top of a loop surface of a cleaning pad (mop head).

In FIG. 15, the body 9 of a surface treating machine of the FIG. 14 type is positioned on top of a loop surface 65 of a cleaning pad (mop head) 12-2. The cleaning pad (mop head) 12-2 of FIG. 15 differs from the cleaning pad (mop head) 12-2 of FIG. 10 and FIG. 11. The cleaning pad (mop head) 12-2 of FIG. 10 and FIG. 11 has loop material 62 entirely enclosing a cotton core 61. In FIG. 15, the cleaning pad (mop head) 12-2 is like the one shown in FIG. 13 where the loop layer 65 is on one side of the cleaning pad 12-2 while the other side is a polypropylene microfiber 66. In some embodiments, the cleaning pad (mop head) 12-2 of FIG. 10 and FIG. 11 has loop material 62 formed of two layers where one of the two layers is sewn on one side of the cotton core 61 and the other one of the two layers is sewn on the other side of the cotton core 61.

Figure 16:
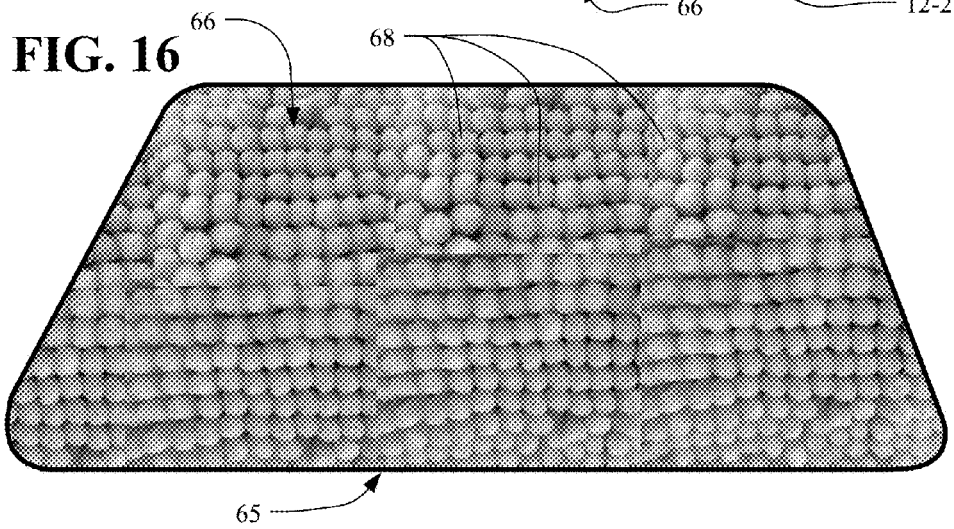
FIG. 16 depicts the floor-cleaning side of the cleaning pad (mop head) shown in FIG. 15.

In FIG. 16, the layer 66 in the embodiment shown is formed of a large number of cylinders 68 of polypropylene microfiber 66 each measuring about 0.4 inches in diameter and about 1 inch high. The polypropylene microfiber 66 is particularly suitable for cleaning tile and hard surface floors and slides over such floors with a comfortable force by the user pushing on the handle 15 (see FIG. 1 and FIG. 2). For cleaning rugs, particularly rugs with deep pile, the polypropylene microfiber 66 requires considerably more force by the user pushing on the handle 15 (see FIG. 1 and FIG. 2) than is required when the cotton member 12-2 of FIG. 10 and FIG. 11 is used.

Figure 17:
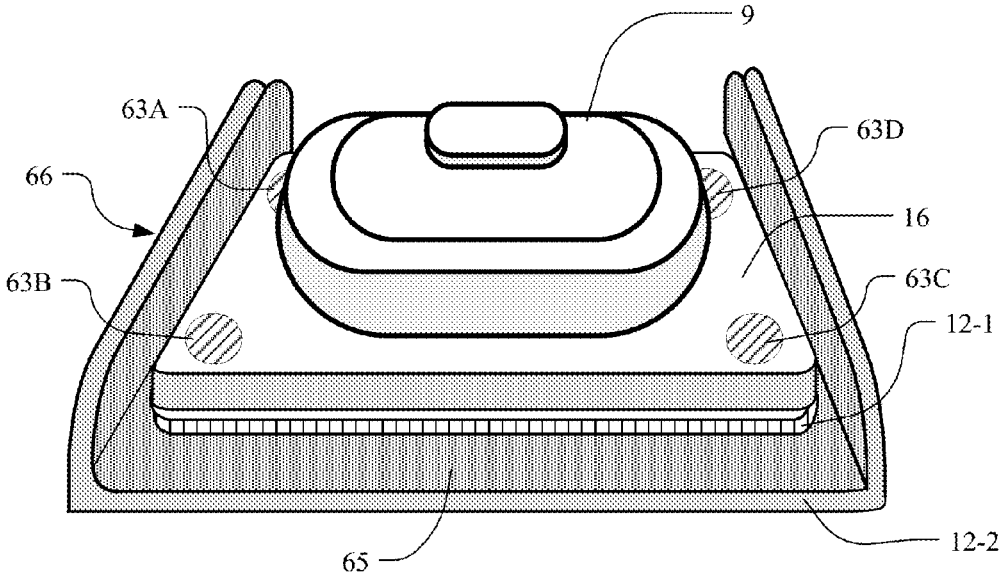
FIG. 17 depicts a schematic representation of the body portion of a surface treating machine of FIG. 14 on top of a cleaning pad (mop head) with the sides of the cleaning pad turned up.

In FIG. 17, a schematic representation of the body 9 of the surface treating machine of FIG. 14 is fastened on top of a cleaning pad (mop head) 12-1 with the sides of the cleaning pad turned up along the edges of the cleaning plate 12-1 and the body plate 16. The cleaning pad 12-2 is like the one shown in FIG. 13 where the loop layer 65 is juxtaposed the cleaning plate 12-1 and is latched to the hooks 53 as shown and described in connection with FIG. 12. The body plate 16 includes hook connectors 63 including hook connectors 63A, 63B, 63C and 63D. The hook connectors 63 are located on the top surface of and generally in the four corners of the body plate 16. The hook connectors 63 are positioned to engage loop material 65 of the cleaning pad 12-2 when the sides of the cleaning pad 12-2 are further turned over so as to contact loop layer 65 with the hook connectors 63A, 63B, 63C and 63D.

Figure 18:
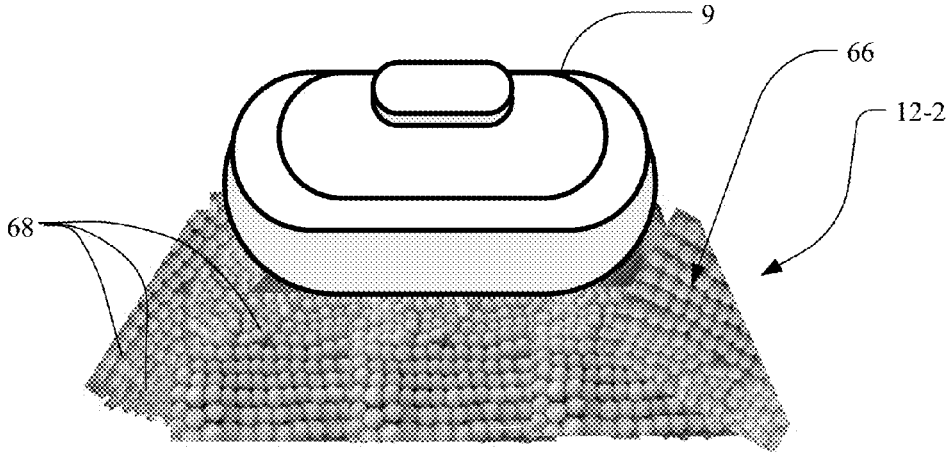
FIG. 18 depicts the body portion of a surface treating machine of FIG. 17 on top of a cleaning pad (mop head) with the sides turned up and attached to the top of the body plate.

In FIG. 18, the body 9 of a surface treating machine of FIG. 17 is on top of a cleaning pad (mop head) 12-2 with the sides turned up and turned over so as to attach to the top of the body plate (see FIG. 17). The hook connectors 63 are positioned to engage loop material 65 of the cleaning pad 12-2 when the sides of the cleaning pad 12-2 are turned up as represented in FIG. 17 and further turned over so as to contact loop layer 65 with the hook connectors 63A, 63B, 63C and 63D (see FIG. 17). In FIG. 18, the layer is formed of a large number of cylinders 68 of polypropylene microfiber 66 each measuring about 0.4 inches in diameter and about 1 inch high.

Figure 19:
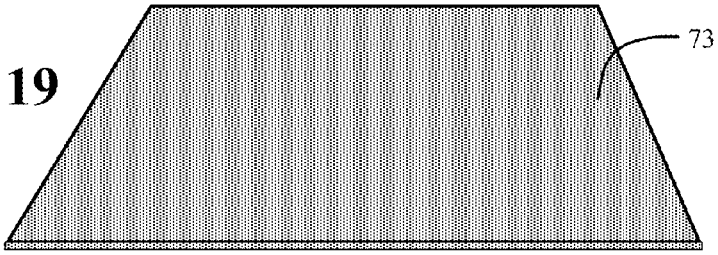
FIG. 19 depicts a loop layer that forms part of a loop and hook assembly.

In FIG. 19, a loop layer 73 is one of the layers that forms part of a loop and hook assembly. The loops of the loop layer 73 form a good loop and hook fastening to hooks that are about 0.04 inch so as to form a good loop and hook fastening, for example, to the loops of the loop layer 65 of FIG. 13.

Figure 20:
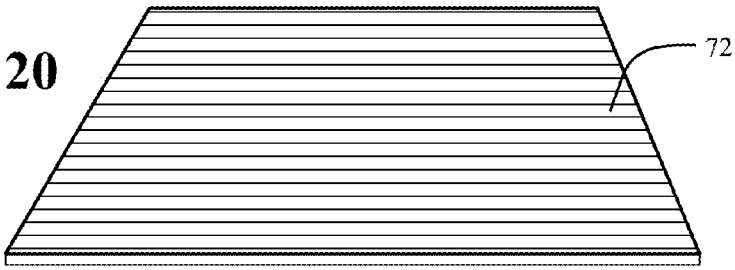
FIG. 20 depicts a plastic layer that forms part of a loop and hook assembly.

In FIG. 20, a plastic layer 72 is another one of the layers that forms part of a loop and hook assembly.

Figure 21:
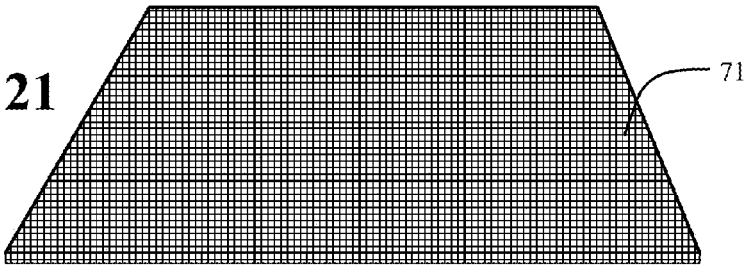
FIG. 21 depicts a hook layer that forms part of a loop and hook assembly.

In FIG. 21, a hook layer 71 is another one of the layers that forms part of a loop and hook assembly. The hooks in hook layer 71 are approximately 0.10 inch which are substantially larger than the hooks that engage loop layer 73.

Figure 22:
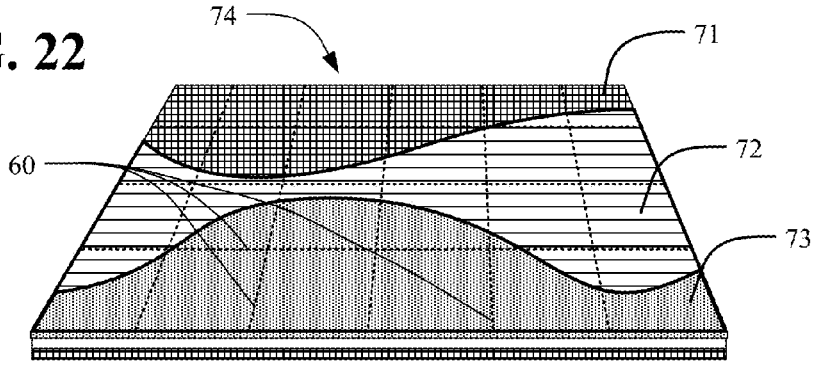
FIG. 22 depicts a cut away view of a loop and hook assembly formed by the combination of the FIG. 19, FIG. 20 and FIG. 21 layers.

In FIG. 22, a cut away view of a loop and hook assembly 74 is formed by the combination of the FIG. 19, FIG. 20 and FIG. 21 layers. The layers 71, 72 and 73 are adhered together to form the loop and hook assembly 74 as a unitary piece. In one embodiment, the layers 71, 72 and 73 are sewn together with the treads 60 to form the unitary structure 74. The loop layer 73 is designed to fasten to the hooks 53 of the cleaning plate 12-1 (see FIG. 12). The loop and hook fastening with hooks 53 and loops of layer 73 use "small hooks" of about 0.04 inch. Similarly, the hook layer 71 provides "small hooks" of about 0.04 inch. As an alternative, the hook layer 71 provides "large hooks" that range from 0.08 inch to 0.25 inch. In one embodiment, the hooks are 0.10 inch. With the selection of small hooks and large hooks, for layers 73 and 71, respectfully, the loop and hook assembly 74 functions as a hook size converter. The small hooks are useful for loop and hook fastening to the cleaning plate 12-1. The large hooks are useful for loop and hook fastening to cleaning heads, such as floor pad heads. In addition to the function of being a hook size converter, the loop and hook assembly 74 functions as a barrier to prevent dirt and liquids from penetrating to the cleaning plate 12-1. Accordingly, the loop and hook assembly 74 is generally larger than the cleaning plate 12-1. In one embodiment, the cleaning plate 12-1 measures 7 inches by 11 inches and the loop and hook assembly 74 measures 8 inches by 12 inches. Although the loop and hook assembly 74 in one embodiment is formed using three separate layers 71, 72 and 73 other structures can be formed. For example, the hooks in layer 71 can be molded as part of the plastic layer 72 thereby eliminating the need for layer 71.

Figures 23, 24:
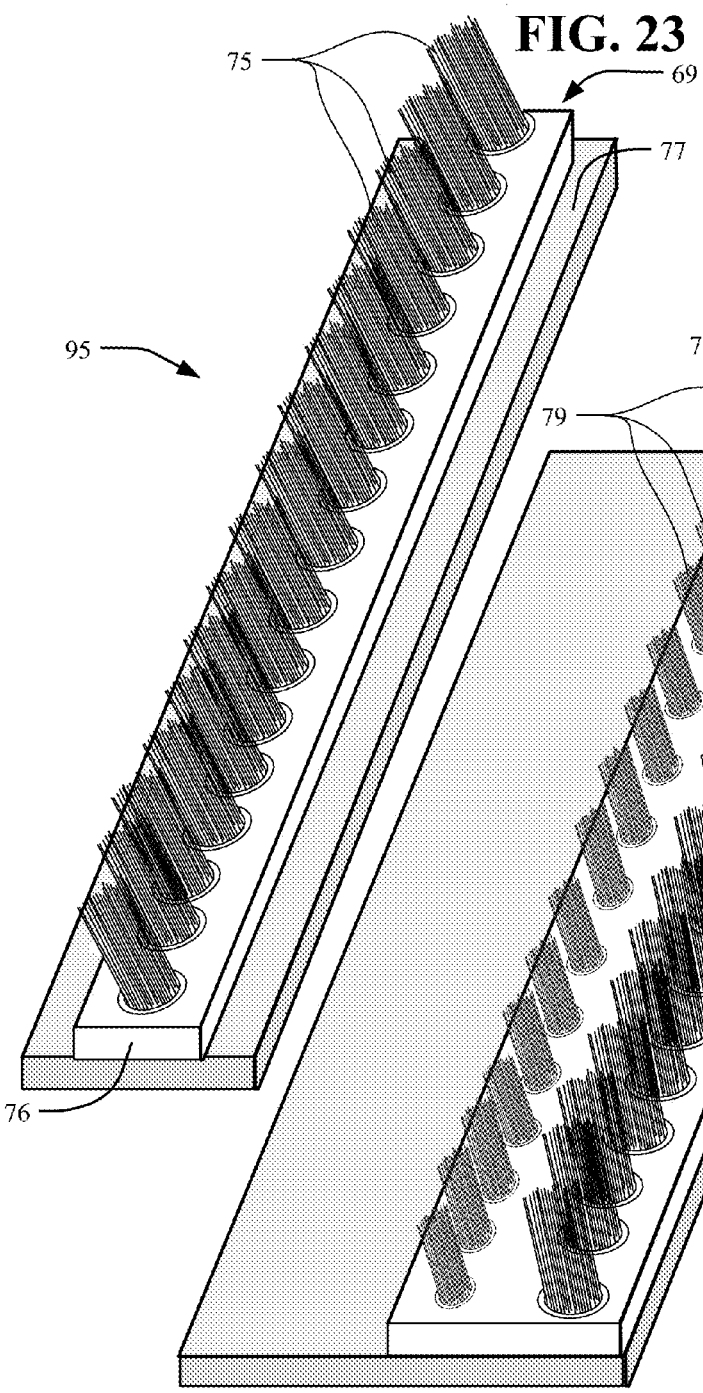
FIG. 23 depicts a single row of brushes mounted on a fastener.
FIG. 24 depicts a double row of brushes mounted on a fastener.

In FIG. 23, a single row of brushes 75 are mounted on a base 76 to form a brush unit 69. In a preferred embodiment, the brushes 75 are polypropylene filaments, the base 76 is polypropylene and the brushes 75 are fused into the base 76 to form the brush unit 69. The brush unit 69 is formed by fusion in the manner provided in brush units from Tucel Industries, Inc., 2014 Forestdale Rd., Forestdale, Vt. 05745. The brush unit 69 is attached to the loop base 77 by adhesive, sewing or other attachment means to form a single brush head 95 for attachment to hooks using a loop and hook fastening mechanism. The loop base 77 has a loop surface forming one part of a loop and hook fastening mechanism. In one embodiment, the loops of the loop base 77 are selected for small hooks that are, for example, 0.04 inch hooks. The loop base 77 is wider than the base 76 to provide an increased area for the loop and hook fastening mechanism.

In FIG. 24, a double row of brushes 75 and 79 are mounted on a base 78 to form a brush unit 70. In a preferred embodiment, the brushes 75 and 79 are polypropylene filaments, the base 78 is polypropylene and the brushes 75 and 79 are fused into the base 78 to form the brush unit 70. The brush unit 70 is formed by fusion in the manner provided in brush units from Tucel Industries, Inc., 2014 Forestdale Rd., Forestdale, Vt. 05745. The brush unit 70 is attached to the loop base 80 by adhesive, sewing or other attachment means to form a double brush head 96 for attachment to hooks using a loop and hook fastening mechanism. The loop base 80 has a loop surface forming one part of a loop and hook fastening mechanism. In one embodiment, the loops of the loop base 80 are selected for small hooks that are, for example, 0.04 inch hooks. The loop base 80 is wider than the base 78 to provide an increased area for the loop and hook fastening mechanism.

Figure 25:
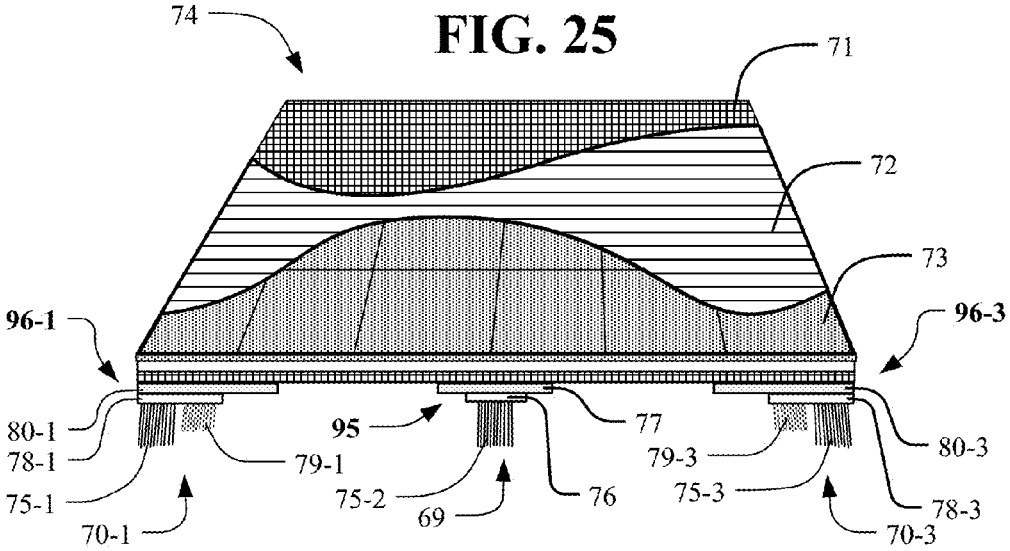
FIG. 25 depicts a top perspective cutaway view of rows of brushes of the FIG. 23 and FIG. 24 type fastened under the loop and hook assembly of the FIG. 22 type.

In FIG. 25, a top perspective cutaway view of the loop and hook assembly 74 of the FIG. 22 type is shown with rows of brushes of the FIG. 23 and FIG. 24 type fastened to the hook layer 71 of the loop and hook assembly 74. Particularly, the brush head 96-1 is attached to one side (left side as viewed in FIG. 25) of the loop and hook assembly 74. The brush head 96-1 includes the double row of brushes 75-1 and 79-1 mounted on a base 78-1 to form a brush unit 70-1.The brush unit 70-1 is attached to the loop base 80-1 forming the double brush head 96-1 with loops fastening to the hook layer 71 of the loop and hook assembly 74. Also, the brush head 96-3 is attached to the opposite side (right side as viewed in FIG. 25) of the loop and hook assembly 74. The brush head 96-3 includes the double row of brushes 75-3 and 79-3 mounted on a base 78-3 to form a brush unit 70-3. The brush unit 70-3 is attached to the loop base 80-3 forming the double brush head 96-3 having loops fastening to the hook layer 71 of the loop and hook assembly 74. The brush unit 69 includes a single row of brushes 75-2 mounted on a base 76. The brush unit 69 is attached to the loop base 77 by adhesive, sewing or other attachment means to form a single brush head 95 for attachment to hooks using a loop and hook fastening mechanism. The brush head 95 is located in the center of the loop and hook assembly 74.

Figure 26:
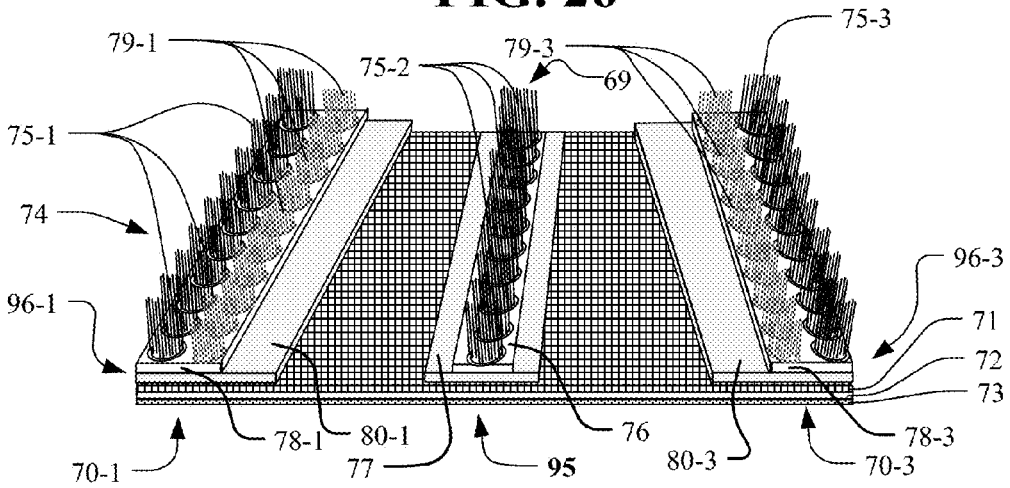
FIG. 26 depicts a bottom perspective view of rows of brushes of the FIG. 23 and FIG. 24 type fastened to the loop and hook assembly of the FIG. 22 type.

In FIG. 26, a bottom perspective view of the loop and hook assembly 74 of the FIG. 22 type is shown with rows of brushes of the FIG. 23 and FIG. 24 type fastened to the hook layer 71 of the loop and hook assembly 74. Particularly, the brush head 96-1 is attached to one side (left side as viewed in FIG. 26) of the loop and hook assembly 74. The brush head 96-1 includes the double row of brushes 75-1 and 79-1 mounted on a base 78-1 to form a brush unit 70-1. The brush unit 70-1 is attached to the loop base 80-1 forming the double brush head 96-1 having loops fastening to the hook layer 71 of the loop and hook assembly 74. Also, the brush head 96-3 is attached to the opposite side (right side as viewed in FIG. 26) of the loop and hook assembly 74. The brush head 96-3 includes the double row of brushes 75-3 and 79-3 mounted on a base 78-3 to form a brush unit 70-3. The brush unit 70-3 is attached to the loop base 80-3 forming the double brush head 96-3 having loops fastening to the hook layer 71 of the loop and hook assembly 74. The brush unit 69 includes a single row of brushes 75-2 mounted on a base 76. The brush unit 69 is attached to the loop base 77 by adhesive, sewing or other attachment means to form a single brush head 95 for attachment to hooks using a loop and hook fastening mechanism. The brush head 95 is located in the center of the loop and hook assembly 74.

Figure 27:
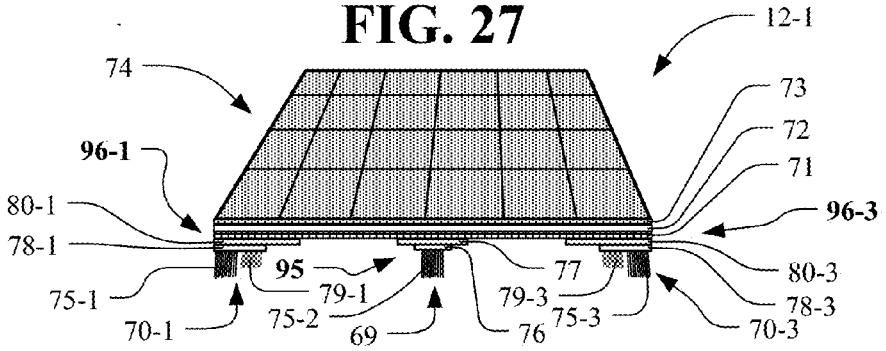
FIG. 27 depicts a top perspective view of a loop, hook and brush head formed of rows of brushes of the FIG. 23 and FIG. 24 type fastened under the loop and hook assembly of the FIG. 22 type.

In FIG. 27, a top perspective view is shown of the FIG. 25 loop and hook assembly 74 with fastened brush heads. Particularly, the brush head 96-1, brush head 96-3 and brush head 95 are detachably fastened to the hook layer 71 of the loop and hook assembly 74 and the heads are spaced apart at any convenient dimension.

Figure 28:
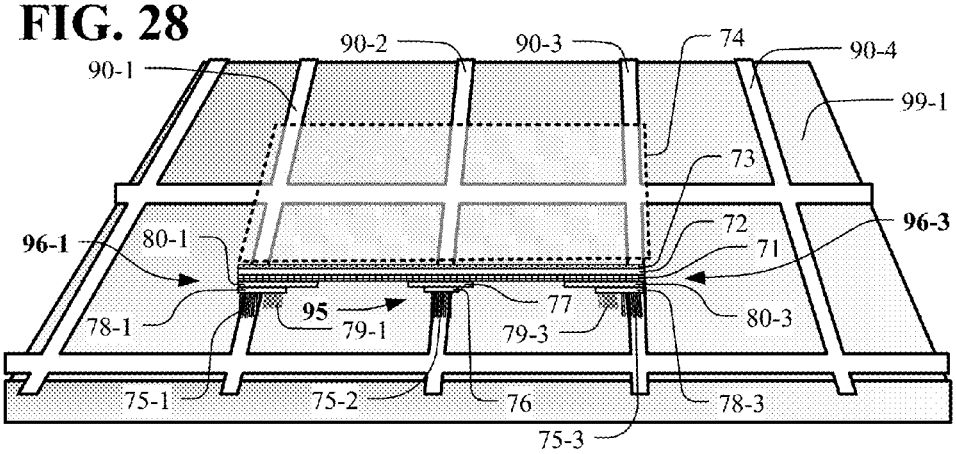
FIG. 28 depicts a top perspective view of the loop and hook assembly of the FIG. 27 type having rows of brushes of the FIG. 23 and FIG. 24 type fastened underneath to the hook layer so as to be aligned with the grout of a tile floor where the grout has a first spacing.

In FIG. 28, a top perspective view of the loop and hook assembly 74 of the FIG. 27 type having brush head 96-1, brush head 95 and brush head 96-3 fastened to the hook layer 71 of the loop and hook assembly 74. The brush head 96-1, brush head 95 and brush head 96-3 are spaced apart so as to be aligned with the grout 90-1, 90-2 and 90-3 of a tile floor 99-1. The grout spacing in the floor 99-1 typically has a uniform spacing of a first grout dimension matching the spacing between brush head 96-1, brush head 95 and brush head 96-3. Because the brush head 96-1, brush head 95 and brush head 96-3 are detachably spaced apart, those heads can be fastened to the loop and hook assembly 74 to match the first grout dimension.

Figure 29:
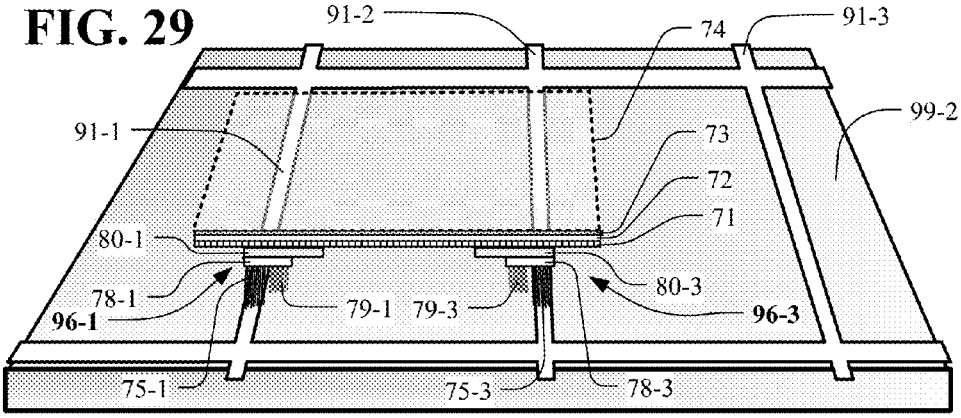
FIG. 29 depicts a top perspective view of the loop, hook and brush head of the FIG. 27 type having rows of brushes of the FIG. 24 type fastened underneath to the hook layer so as to be aligned with the grout of a tile floor where the grout has a second spacing.

In FIG. 29, a top perspective view of the loop and hook assembly 74 of the FIG. 27 type having brush head 96-1 and brush head 96-3 (brush head 95 has been removed) fastened to the hook layer 71 of the loop and hook assembly 74. The brush head 96-1 and brush head 96-3 are aligned with the grout 91-1 and 91-2 of a tile floor 99-2. The grout spacing in the floor 99-2 typically has a uniform spacing of a second grout dimension, less than the first grout dimension of FIG. 28. The brush head 96-1 and brush head 96-3 are detachably fastened to the hook layer 71 of the loop and hook assembly 74. The brush head 96-1 and brush head 96-3 are spaced apart to match the second grout dimension of the floor 99-2. The spacing between brush head 96-1 and brush head 96-3 has been set by moving the brush head 96-1 and brush head 96-3 in FIG. 27 to match the second grout dimension of tile floor 99-2.

Figure 30:
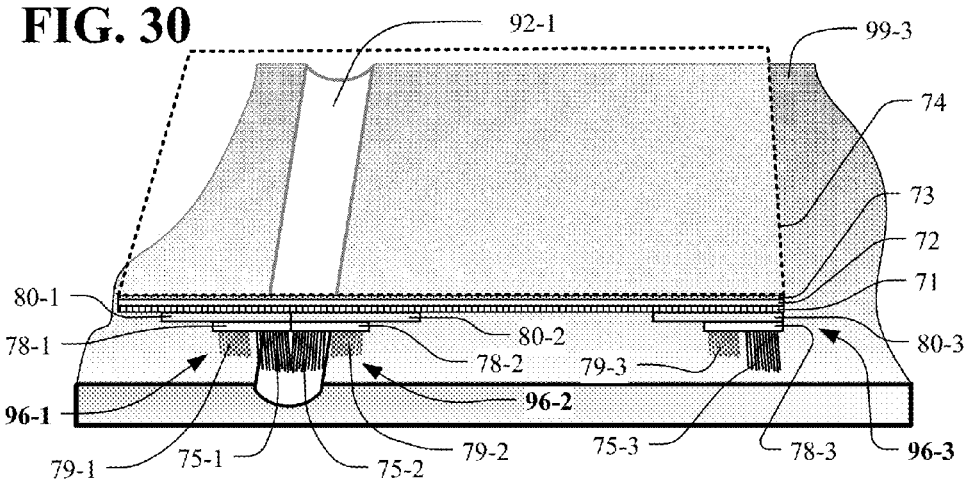
FIG. 30 depicts a top perspective view of the loop, hook and brush head of the FIG. 27 type having rows of brushes of the FIG. 24 type fastened underneath to the hook layer so as to be aligned with the grout of a tile floor where the grout has a wider dimension than the grout of FIG. 29.

In FIG. 30, a top perspective view of the loop and hook assembly 74 of the FIG. 27 type having brush head 96-1, brush head 96-2 and brush head 96-3 detachably fastened to the hook layer 71 of the loop and hook assembly 74. The brush head 96-1 and brush head 96-2 are aligned with the grout 92-1 of a tile floor 99-3. The grout spacing (not shown) in the floor 99-3 typically has a uniform spacing of a third grout dimension larger than the possible spacing between brush heads for the loop and hook assembly 74 used in FIG. 28 and FIG. 29. Of course, a loop and hook assembly larger than the loop and hook assembly 74 can be employed for larger grout spacing. In one embodiment, the cleaning plate 12-1 for a surface treating machine (see FIG. 16, for example) has dimensions of 7 inches by 11 inches. With such dimensions, the cleaning plate 12-1 by itself is not wide enough to mount brush heads for cleaning grout with a grout dimension of 12 inches. However, using a loop and hook assembly 74 with a width of approximately 13 inches or more allows brush heads to be spaced apart so as to be able to clean grout with a grout dimension of 12 inches.

In FIG. 30, the width of the grout 92-1 is greater than the width of the grouts 90 and 91 in FIG. 28 and FIG. 29. The brush head 96-1 and brush head 96-2 are fastened side by side to fill the larger grout width of grout 92-1. Of course, brush heads of many different sizes are available or can be made to be detachably fastened to the hook layer 71 of the loop and hook assembly 74.

Figure 31:
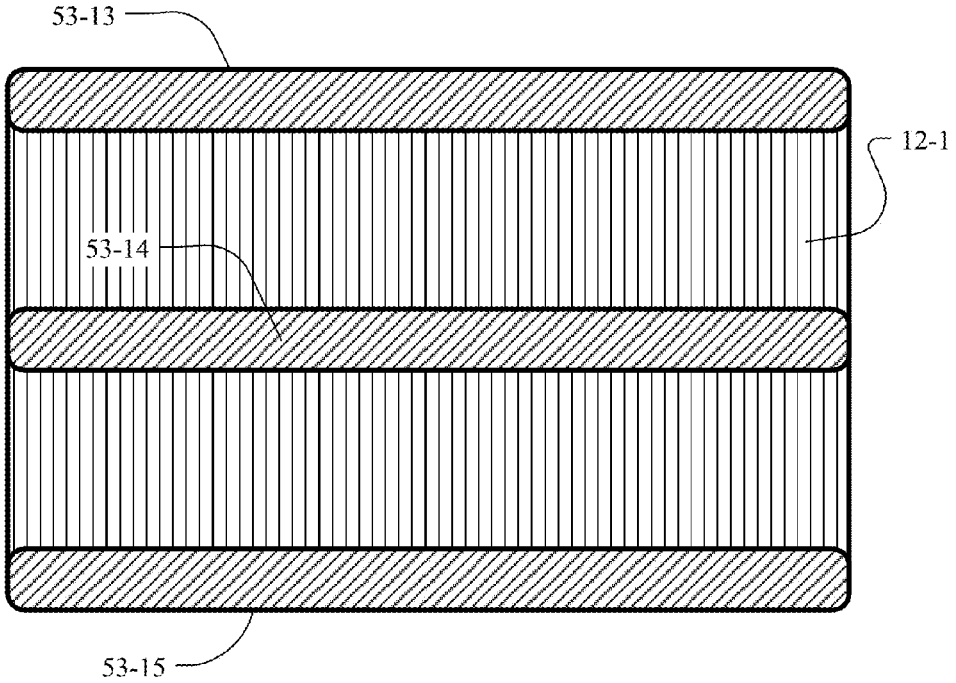
FIG. 31 depicts a bottom view of the cleaning plate having three rows of hook attachment pads.

In FIG. 31, a bottom view of the cleaning plate 12-1 and three rows of hook attachment pads 53-13, 53-14 and 53-15 are shown. The hooks for the pads can be of any convenient size. For example, the small hooks as described in connection with FIG. 12 can be employed and will fasten well with the mop head 12-2 of FIG. 13 and the brush head 95 and brush head 96 of FIG. 23 and FIG. 24. Regardless as to what size hooks are selected, a loop and hook assembly like loop and hook assembly 74 of FIG. 22 can be employed to change and interface different loop and hook sizes whether from small to large or alternatively from large to small. A large to small interface is achieved for the loop and hook assembly 74 of FIG. 22 by making layer 73 for large hooks and layer 71 small hooks. Also, no change in hook size is necessary. For example, layer 73 and layer 71 can both be for small hooks or can both be for large hooks.

Figure 32:
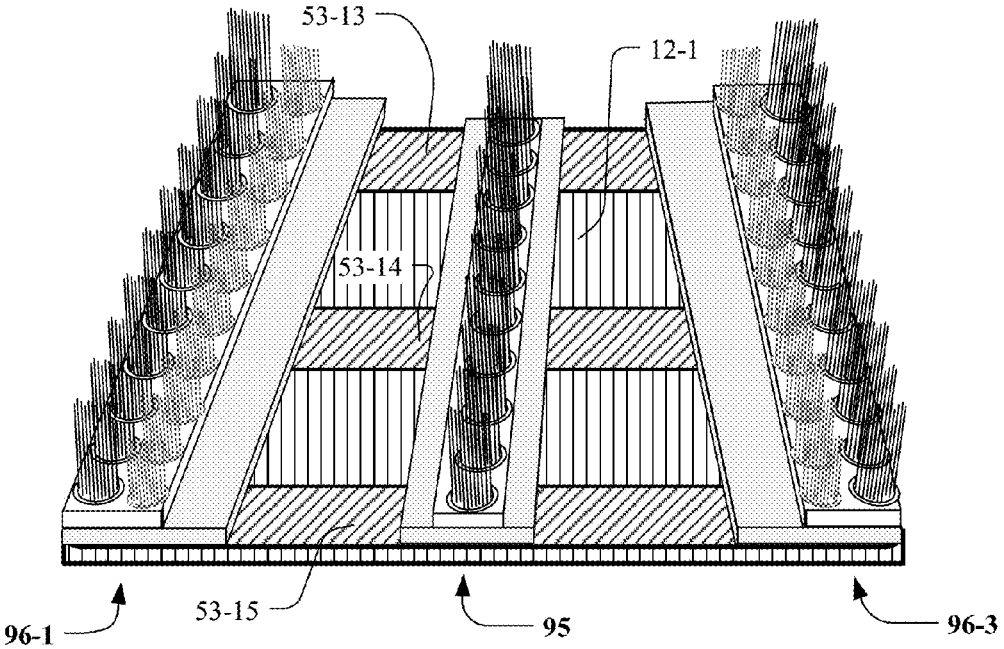
FIG. 32 depicts a bottom view of the cleaning plate of FIG. 31 having three rows of brush heads attached to the attachment pads.

In FIG. 32, a bottom view is shown of the cleaning plate of FIG. 31 having three rows of brush heads with small hooks attached to the attachment pads 53-13, 53-14 and 53-15. The pads 53-13, 53-14 and 53-15 in this embodiment have small hooks and no loop and hook assembly 74 of FIG. 22 type is not required. A loop and hook assembly 74 of FIG. 22 type can be used to provide a barrier to dirt and solutions reaching the cleaning plate 12-1. Such a loop and hook assembly 74 can have both layers 71 and 73 for loop and hook fastening with large hooks or small hooks or can have hook size changes from small to large or vice versa.

Figure 33:
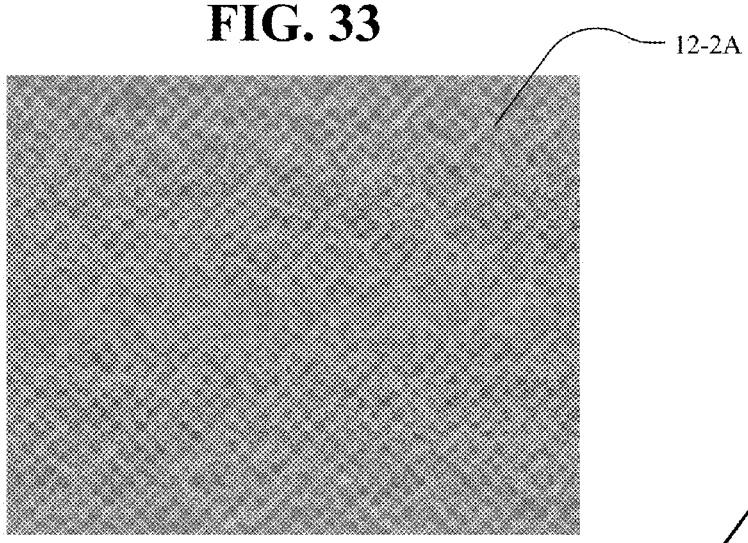
FIG. 33 depicts a top view of a mineral abrasive floor pad head.

In FIG. 33, a top view is shown of a mineral abrasive floor pad head 12-2A. Such pads are available in many sizes and levels of abrasiveness. One of the largest vendors of such pads is 3M and the 3M™ Floor Pads are advertised to have uniform coating throughout helping to produce a long, useful life, resulting in less pad usage. The 3M™ Floor Pads are washable and reusable. The floor pad head 12-2A of FIG. 33 is best fastened with large hooks. For example, a cleaning plate 12-1 of FIG. 14 having small hooks fastens to a loop and hook assembly 74 where the layer 73 is for small hooks and layer 71 is large hooks. The floor pad head 12-2A fastens to the large hooks of layer 71.

Figure 34:
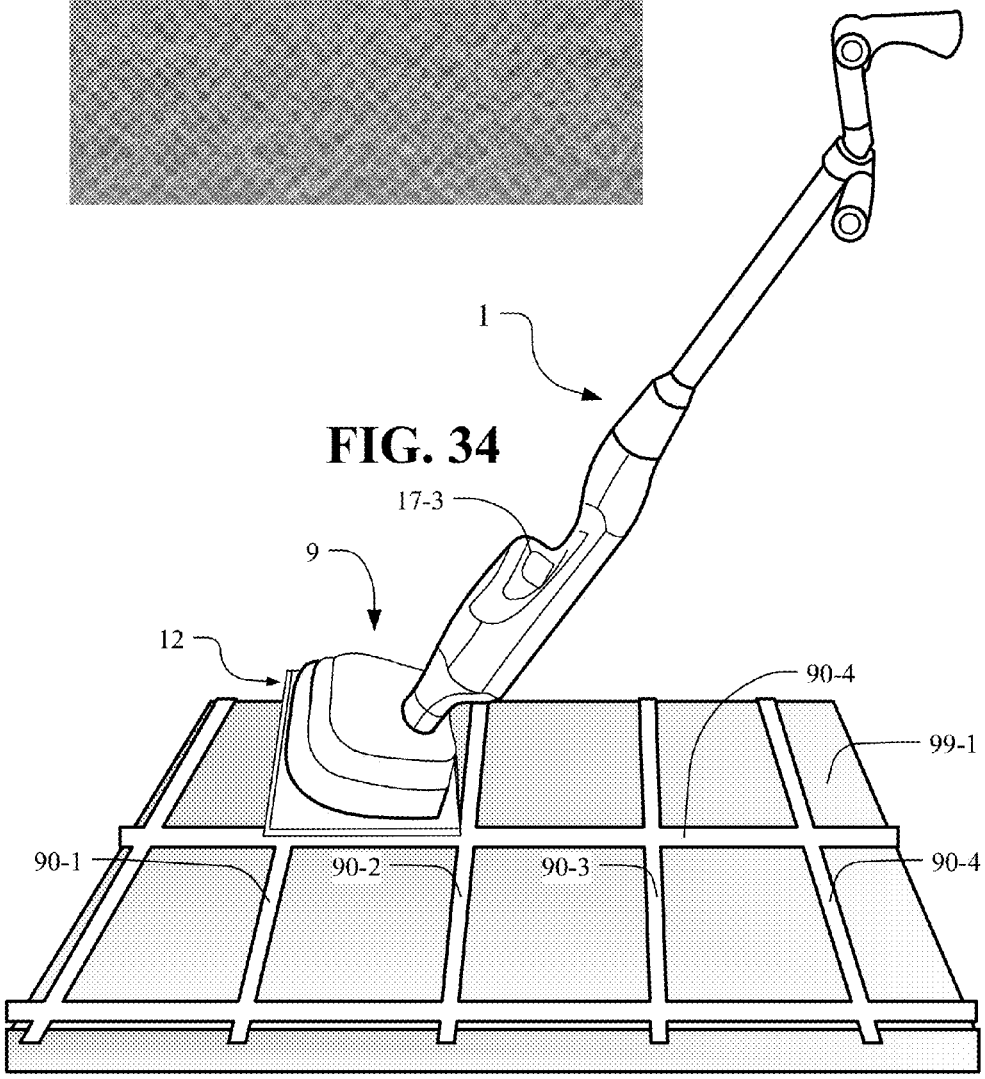
FIG. 34 depicts an isometric view of surface treating machine of the FIG. 2 type rotated up so that only one edge is in contact with a floor.

FIG. 34 depicts an isometric view of surface treating machine of the FIG. 2 type rotated up so that only one edge is in contact with a floor. Such rotation concentrates the cleaning action along one edge of the surface treating machine and applies a greater force along that edge than the force applied when not titled. Such titled cleaning is particularly effective using abrasive floor pad heads.

While the invention has been particularly shown and described with reference to preferred embodiments thereof it will be understood by those skilled in the art that various changes in form and details may be made therein without departing from the scope of the invention.

The invention claimed is:

1. A machine for treating a surface lying in an XY-plane comprising, a body, a body plate attached to the body, a drive assembly attached to the body including a motor and a transmission, a cleaning plate assembly including, a cleaning plate connected to the transmission to be driven in an oscillating pattern parallel to the XY-plane and relative to the body plate, the cleaning plate including a cleaning plate surface, the cleaning plate surface including one of a hook surface or a loop surface, a loop and hook assembly including one side and including an opposite side, the one side including one of a one-side hook surface or a one-side loop surface for engaging the cleaning plate surface and the opposite side including one of an opposite-side hook surface or an opposite-side loop surface, one or more cleaning heads for detachably fastening to the cleaning plate by the loop and hook assembly, each of the cleaning heads including a cleaning head surface wherein the cleaning head surface includes one of a head hook surface or a head loop surface whereby one or more of the cleaning heads is detachably fastened to the opposite side of the of the loop and hook assembly by loop and hook fastening.

2. The machine of claim 1 wherein one or more of the cleaning heads includes a mop head including a cleaning fiber attached to a loop layer.

3. The machine of claim 2 wherein the cleaning fiber is a polypropylene microfiber formed of cylinders with approximately 12 cylinders per square inch where each cylinder has a diameter of approximately 0.25 inch and a height of approximately 0.6 inch.

4. The machine of claim 2 wherein one or more of the cleaning heads includes an abrasive floor pad head for detachably fastening to a hook layer.

5. The machine of claim 1 wherein one or more of the cleaning heads includes one or more brush heads, each of the brush heads having a loop layer for detachably fastening to a hook layer or a hook layer for detachably fastening to a loop layer.

6. The machine of claim 5 wherein the one or more brush heads include two or more of the brush heads spaced apart by a dimension that matches a grout spacing of a tile floor to be cleaned.

7. A machine for treating a surface lying in an XY-plane comprising, a body, a handle assembly connected to the body to allow a user to control movement of the machine over the surface, a drive assembly, having a drive assembly height dimension measured from the XY-plane, attached to the body and including:

a motor having a motor drive shaft, a transmission having offset drivers driven by the motor drive shaft and wherein the offset drivers include a first offset driver having a first offset-driver shaft driven by the motor drive shaft and include a second offset driver having a second offset-driver shaft driven by the motor drive shaft, a cleaning plate assembly, located between the drive assembly and the XY-plane, and including, a cleaning plate having an eccentric drive member engaging the offset drivers to drive the cleaning plate assembly in an oscillating pattern parallel to the XY-plane, the cleaning plate including a cleaning plate surface, the cleaning plate surface including a hook surface, a loop and hook assembly including one side and including an opposite side, the one side including a one-side loop surface for engaging the hook surface of the cleaning plate surface and the opposite side including an opposite-side hook surface, one or more cleaning heads detachably fastened to the cleaning plate by the loop and hook assembly wherein each of the cleaning heads includes loop surface whereby each of the cleaning heads is detachably fastened to the opposite-side hook surface of the of the loop and hook assembly by loop and hook fastening.

8. The machine of claim 7 wherein the one or more cleaning heads includes a mop head including a cleaning fiber attached to a loop layer and wherein the cleaning fiber is a polypropylene microfiber formed of cylinders with approximately 12 cylinders per square inch where each cylinder has a diameter of approximately 0.25 inch and a height of approximately 0.6 inch.

9. The machine of claim 7 wherein the one or more cleaning heads includes one or more brush heads, each of the brush heads having a loop layer for detachably fastening to a hook layer.

10. The machine of claim 9 wherein the one or more brush heads include two or more brush heads adjustably spaced apart by any dimension.

11. The machine of claim 7 wherein the one or more cleaning heads includes an abrasive floor pad head for detachably fastening to a hook layer.

12. The machine of claim 7 wherein the loop and hook assembly includes a plastic layer that is greater in size than the cleaning plate whereby the cleaning plate is protected from liquid and dirt.

13. A machine for treating a surface lying in an XY-plane comprising, a body including a body plate, a drive assembly including, a motor and a transmission, a cleaning plate assembly including, a cleaning plate connected to the transmission to be driven in an oscillating pattern parallel to the XY-plane and relative to the body plate, the cleaning plate including a cleaning plate surface, the cleaning plate surface including a hook surface, a loop and hook assembly including one side and including an opposite side, the one side including a one-side loop surface for engaging the hook surface of the cleaning plate surface and the opposite side including an opposite-side hook surface, one or more cleaning heads for detachably fastening to the cleaning plate h the loop and hook assembly, each of the cleaning heads including a cleaning head surface wherein the cleaning head surface includes a head loop surface whereby each of the cleaning heads is detachably fastened to the opposite side of the of the loop and hook assembly by loop and hook fastening.

14. The machine of claim 13 wherein the loop and hook assembly is greater in size than the cleaning plate.

15. The machine of claim 13 wherein the one or more cleaning heads includes one or more brush heads, each of the brush heads having a loop layer for detachably fastening to the opposite-side hook surface of the loop and hook assembly.

16. The machine of claim 13 wherein the hook surface on the cleaning plate includes small hooks of less than 0.08 inch, wherein the one-side loop layer fastens to small hooks of the cleaning plate and the opposite-side hook layer includes small hooks of less than 0.08 inch.

17. The machine of claim 13 wherein the hook surface on the cleaning plate includes large hooks in a range from about 0.08 inch to 0.25 inch, wherein the one-side loop layer fastens to the large hooks of the cleaning plate and wherein the opposite-side hook layer includes large hooks in a range from about 0.08 inch to 0.25 inch.

18. The machine of claim 13 wherein the hook surface on the cleaning plate includes small hooks of less than 0.08 inch, wherein the one-side loop layer fastens to the small hooks of the cleaning plate and wherein the opposite-side hook layer includes large hooks in a range from about 0.08 inch to 0.25 inch.

19. The machine of claim 13 wherein the hook surface on the cleaning plate includes large hooks in a range from about 0.08 inch to 0.25 inch, wherein the one-side loop layer fastens to the large hooks of the cleaning plate and wherein the opposite side hook layer includes small hooks of less than 0.08 inch.

* * * * *